United States Patent [19]

Masuda

[11] Patent Number: 4,665,476

[45] Date of Patent: May 12, 1987

[54] HIGH-VOLTAGE PULSE POWER SOURCE AND PULSE-CHARGING TYPE ELECTRIC DUST COLLECTING APPARATUS EQUIPPED THEREWITH

[76] Inventor: Senichi Masuda, No. 415, Nishigahara 3-2-1, Kita-ku, Tokyo, Japan

[21] Appl. No.: 686,286

[22] Filed: Dec. 26, 1984

[30] Foreign Application Priority Data

Dec. 28, 1983 [JP] Japan ..... 58-248354
Jan. 19, 1984 [JP] Japan ..... 59-7770

[51] Int. Cl.[4] ..... B05B 5/00; B03C 3/68

[52] U.S. Cl. ..... 363/86; 363/128; 320/1; 55/105; 55/139; 323/903

[58] Field of Search ..... 363/27-28, 363/85-86, 128, 106-108; 323/266, 903; 320/1; 307/106-108; 55/105, 139

[56] References Cited

U.S. PATENT DOCUMENTS 3,560,805 2/1971 Gilbert ..... 320/1 X
3,723,849 3/1973 Ludloff ..... 363/86
3,737,758 6/1973 Allington ..... 363/86
4,107,757 8/1978 Masuda et al. ..... 320/1 X
4,238,810 12/1980 Stevenson et al. ..... 363/86 X
4,390,831 6/1983 Byrd et al. ..... 363/86 X

*Primary Examiner*—Peter S. Wong
*Attorney, Agent, or Firm*—Price, Heneveld, Cooper, DeWitt & Litton

[57] ABSTRACT

A novel high-voltage pulse power source comprising an ON-OFF type high-voltage switch element, as high-voltage switch element, which can be reset in OFF state immediately after an ON action, and a current blocking mechanism arranged in the charging power source, whereby an output current from the charging source is inhibited by said current blocking mechanism to stop charging and generating of any dynamic current flow into the load during period of time from an ON action of said ON-OFF type high-voltage switch element till an OFF action of the same, and the flow of said output current is restored during an OFF state of said ON-OFF type high-voltage switch element after an OFF action of the same. In addition, a novel pulse-charging type electric dust collecting apparatus equipped with said novel high-voltage pulse power source.

37 Claims, 24 Drawing Figures

HIGH-VOLTAGE PULSE POWER SOURCE AND PULSE-CHARGING TYPE ELECTRIC DUST COLLECTING APPARATUS EQUIPPED THEREWITH

FIELD AND BACKGROUND OF THE INVENTION

The present invention relates to an economical high-voltage pulse power source of high performance for applying a steep pulse voltage to a load consisting of a resistive load or a corona discharge load and an electrostatic capacity connected in parallel thereto, such as load in electric dust collecting apparatus or ozonizer. The invention is also concerned with a pulse-charging type electric dust collecting apparatus equipped with said high-voltage pulse power source.

In the prior high-voltage pulse power sources for above-mentioned kinds of load, the common practice is that, after a pulse voltage-forming capacitor has been charged with a D.C. power source for charging, the capacitor is momentarily connected to the load to discharge via a high-voltage switch element, and a pulse high voltage resulting from CR attenuation is generated between both ends of the load. Because of the difference in D.C. voltage level between the high-voltage pulse power source and the load, it is usual in these cases to connect the power source with the load by means of a pulse transformer and a coupling capacitor. However, with this structure as such, said pulse voltage-forming capacitor is again charged to a high voltage by the D.C. charging power source after an ON action of said high-voltage switch element. As a result, the high-voltage switch element is reignited and a dynamic current flows from the charging power source to the load. Consequently, a periodic pulse voltage cannot be generated. To prevent this phenomenon, a method is devised that a high current-limiting resistance is interposed between the D.C. charging power source and the pulse voltage-forming capacitor for limiting the rate of recharging. Thus, the reset to OFF state of high-voltage switch element after ON action thereof is ensured by extinction. However, when a high current-limiting resistance sufficient to secure the reset to OFF state is employed, the drawback resides in that an excessive time is required to charge the pulse voltage-forming capacitor and a high frequency of pulse voltage cannot be obtained. Moreover, the power loss due to this current-limiting resistance is great and the power efficiency of high-voltage pulse power source is far lowered. This is another drawback. These drawbacks have prevented the method to be practised.

In the prior art, it is well known a "method of pulse-charging" wherein a periodic pulse high-voltage, in place of D.C. high-voltage, is impressed on the discharge electrode of electric dust collecting apparatus to enhance the performance of dust collecting. However, in all prior systems, the pulse high-voltage is superimposed on the existing D.C. high voltage of the discharge electrode. Accordingly, it is required that any coupling interface, such as pulse transformer, coupling capacitor and a combination thereof, is inserted between the output terminal of high-voltage pulse power source and the discharge electrode so that the D.C. continuity may be broken but any pulse voltage may be freely transferred. By this usual provision, the direct connection between the high-voltage pulse power source and the discharge electrode is avoided and the impression of D.C. high-voltage of discharge electrode onto the output side of high-voltage pulse power source can be prevented. However, as the electric dust collecting apparatus is scaled up, the required capacity of said coupling interface becomes very large. Thus, the cost of the construction remarkably increases. In addition, the power loss in the interface is increased excessively. As a result, the realisation of the pulse-charging method itself becomes scarcely practicable.

SUMMARY OF THE INVENTION

It is, therefore, an object of the present invention to provide a low cost high-voltage pulse power source having high efficiency wherein above-mentioned drawbacks of the prior art removed by simple means.

It is another object of the present invention to realize and provide a low cost pulse-charging type electric dust collecting apparatus having high efficiency wherein the difficult problems in practising a pulse-charging type electric dust collecting apparatus of the prior art are solved.

The former object can be accomplished according to this invention by a system comprising (1) employing, as a high-voltage switch element, an ON-OFF type high-voltage switch element which can be reset in OFF state immediately after an ON action, and (2) providing the charging power source with a current blocking mechanism. This mechanism is so constructed that the output current from the charging power source may be inhibited during the continuity period of said high-voltage switch element from ON action of said switch element till a reset in OFF state thereof. Thus, the charging of the pulse voltage-forming capacitor is inhibited during said continuity period to prevent the generation of a dynamic current to the load. The mechanism is also so constructed that the above-mentioned output current from the charging power source is restored during an OFF state period after a reset in OFF state of high-voltage switch element.

In accordance with the present invention, there is provided a novel high-voltage pulse power source which comprises a pulse voltage-forming capacitor connected to one end of a load, a charging high-voltage power source connected to both ends of said capacitor for charging the same, and a high-speed high-voltage switch element which is inserted between another terminal of said capacitor and another terminal of said load, said switch element being capable of connecting periodically both terminals for a short period of time for applying the charging voltage of capacitor to both ends of said load as pulse high-voltage, which is characterized by comprising an ON-OFF type high-speed high-voltage switch element, as said high-speed high-voltage switch element, which can be reset in OFF state immediately after an ON action; and a charging high-voltage power source equipped with a current blocking mechanism, as said charging high-voltage power source, the current blocking mechanism of which inhibits any output current from said charging power source to prevent charging of said pulse voltage-forming capacitor at least during switch-on period from an ON action of said ON-OFF type high-speed high-voltage switch element to a reset in OFF state of the same, with a result of preventing any generation of dynamic current into said load, the output current inhibiting function mentioned above of said current blocking mechanism being removed during switch-off period of said ON-OFF type high-speed high-voltage switch element for enabling charging of pulse voltage-forming capacitor; thereby a pulse high-voltage is applied to both ends of said load by turning on and off said ON-OFF type high-speed high-voltage switch element with actuating the current inhibiting function of said current blocking mechanism, then, said pulse-forming capacitor is charged by removing said current inhiting function of current blocking mechanism and thereafter all above-mentioned operations are repeated periodically for applying a periodic pulse high voltage to said load.

As a result of such a feature, when said ON-OFF type high-speed high-voltage switch element is in ON state, charging of said pulse voltage-forming capacitor with said charging power source and hence the generation of any dynamic current are completely inhibited. Consequently, the aforementioned current-limiting resistance can be completely omitted. This omission results in that the upper limit of obtainable frequency rises to a far higher level and the power loss in limiting-current resistance is eliminated. Moreover, the omission brings out a beneficial effect that the power efficiency becomes remarkably high.

The current blocking mechanism which is the basis for realizing the above-mentioned feature of this invention can be any mechanism or element which can inhibit charging of the capacitor by the charging power source and the generation of a dynamic current into the load at least during the switch-on state of the high-voltage switch element, and enables sufficiently charging of said capacitor by said charging power source during the switch-off state of said switch element. Suitable mechanisms consisting of circuit elements, mechanical elements and combinations thereof are employable. As ON-OFF type high-voltage switch element of this invention are employable solid switch elements, such as thyristor and power transistor, discharge tube switch elements, such as thyratron and hydrogen thyratron, mechanical switch elements, such as spark gap, spark gap with trigger electrode, laser trigger type spark gap and rotary spark gap, and any other suitable elements. As pulse-forming capacitor of the present invention are employable oil-impregnated paper capacitor, ceramic capacitor, cable, and any other suitable elements. However, those having low internal inductance are preferred. Any power source having constant or variable output voltage can be employed as charging power source of the present invention. As the method for generating variable voltage are employable a system that the input A.C. voltage is controlled by an induction regulator or a saturable reactor, a system that the input A.C. voltage or current is phase controlled by anti-parallel connected thyristors, and any like systems. The charging power source can be constituted by a system wherein a half- or full-wave rectifier is attached to the secondary side (high-voltage side) of a high-voltage transformer, a system wherein a capacitor is further attached to the above-mentioned system, a system wherein a suitable inductance is connected in series to said rectifier, thereby the charging voltage surpassing the crest value of voltage on secondary side of transformer because of resonance charging, or a system wherein the charging voltage is elevated by means of a voltage doubler or multiplier rectifying circuit. In addition, it is obvious that as A.C. power source to be connected to the primary side of transformer are employable a commercial frequency power source, a power source having a frequency other than commercial one constituted with inverter circuit, and a variable frequency power source.

The second object mentioned above, i.e. the provision of a novel pulse-charging type electric dust collecting apparatus, is achieved in accordance with this invention by a concept that the crest value of output pulse voltage of pulse high-voltage power source is set to be a high value corresponding to the necessary maximum peak voltage between pulse charged discharge electrode and pulse charged dust collecting electrode of an electric dust collecting apparatus to be pulse charged, and, thereafter, the output terminals of said pulse high-voltage power source are directly connected to said discharge electrode and said dust collecting electrode without intervention of any interface. Generally in the prior art, the pulse high-voltage power source consists of a pulse voltage-forming capacitor, a charging power source therefor, and a high-voltage switch element for momentarily connecting and applying a charging voltage thereof to a load. However, when the output terminals of said pulse high-voltage power source are directly connected to discharge electrode and dust collecting electrode, the continuity between said charging power source and said discharge electrode and dust collecting electrode is maintained after an ON action of said high-voltage switch element. Thus, after the impression of a pulse high-voltage by momentary discharge of said capacitor, a dynamic current is fed between both electrodes. As a result, a D.C. charging voltage is continuously applied between both electrodes and the pulse charging action is not conducted.

In accordance with the present invention, to overcome these difficulties, (1) an ON-OFF type high-voltage switch element which can be reset in OFF state immediately after an ON action is used as said high-voltage switch element, and (2) the charging power source is provided with a current blocking mechanism. This mechanism is so contructed that the output current from the charging power source may be inhibited during the continuity period of said high-voltage switch element from ON action of said switch element till a reset in OFF state thereof. Thus, the charging of said pulse voltage-forming capacitor during said continuity period is inhibited to prevent the generation of a dynamic current to both electrodes. The current blocking mechanism is also so constructed that the aforementioned output current from the charging power source may be restored during an non-continuity period after a reset in OFF state of high-voltage switch element.

In this case, although it is economical that the electrostatic capacity $C_0$ of said pulse voltage-forming capacitor is made as low as possible, an output pulse voltage of sufficiently high crest value can not be obtained by a capacitor having too low electrostatic capacity. Accordingly, it is desired that the capacity $C_0$ is of the same order with the electrostatic capacity $C_d$ between discharge electrode and dust collecting electrode. The pulse charging actuation resulting from constructing the high-voltage pulse charging power source as mentioned above will be mentioned in the following. First, the high-voltage switch is actuated to be in ON state at a point of time $t_1$ during said current blocking mechanism actuating the current blocking function. At this moment, the charging voltage $V_0$ of said pulse voltage-forming capacitor is applied between said discharge electrode and said dust collecting electrode through the total inductance L and the total resistance R comprising an inductance and an resistance of connecting lead and an inductance and an resistance of high-voltage switch element itself. As a result, a transient high-frequency oscillation, at first, is generated in the series circuit $C_0$-L-R-$C_d$. Due to initial peak voltage of the oscillation, a peak pulse high-voltage $V_p$ of short duration is momentarily applied to the discharge electrode and the dust collecting electrode as shown in FIG. 8B of the accompanying drawings so that a uniform pulse corona discharge is generated on the whole discharge electrode. A plasma containing an abundance of positive and negative ions is brought about. In FIG. 8B, the ordinate $v_d$ denotes the voltage between both electrodes, and the abscissa t denotes the time. When $C_0 >> C_d$, the value $V_p$ of peak voltage due to transcient oscillation becomes maximum to form peaking and the relation $V_p = 2V_0 - V_b$ holds. As $C_0$ approaches $C_d$, the value $V_p$ lowers. When $C_0 = C_d$, the relation $V_p \simeq V_0$ holds. This transcient phenomenon attenuates within a relatively short time. Thereafter, the value $v_d$ of the voltage between two electrodes CR attenuates relatively slow by corona discharge, with the initial voltage corresponding to $V_1 = V_0/(C_0 + C_d)$. In other words, unipolar ions are withdrawn from said plasma wherein the recombination proceeds by D.C. field formed between both electrodes and flow to the dust collecting electrode as ionic current. As such an ionic current flows, the charge stored in $C_0$ and $C_d$ is consumed and the voltage $v_d$ between both electrodes decreases. At a certain point of time $t_2$ in the course of this attenuation, said high-voltage switch element takes OFF state. Thereupon $C_0$ is isolated and the attenuation of $v_d$ is caused only by consumption of charge of $C_d$. Thus, the rate of attenuation changes. At this time, a decrease in ionic current itself accompanys the lowering of voltage $v_d$ and influences the subsequent rate of attenuation. On the other hand, the voltage $v_c$ of pulse voltage-forming capacitor maintains the value $v_d$ at point of time $t_2$ till the point of time $t_3$ of next charging, as shown in FIG. 8A. The attenuation of $v_d$ can continue till the next pulse voltage impression. Otherwise, the attenuation can cease at a certain point of time before next pulse voltage impression due to elimination of ionic current by extinction of said plasma or lowering of $v_d$ below D.C. voltage of corona initiation. In either case, the value $v_d$ takes the lowest value $V_b$ immediately before the next pulse charging. After the high-voltage switch element has been reset in OFF state, the pulse voltage-forming capacitor is charged again to $V_0$ by removing the current blocking function of said current blocking mechanism at point of time $t_3$. Then, after the current blocking function of current blocking mechanism is restored at point of time $t_4$ before $t_1$, said high-voltage switch element is turned on and hence a high-voltage pulse is applied between both electrodes. These operations are repeated.

To both electrodes is applied a periodic pulse high-voltage, as shown in FIG. 8B, consisting of an initial transcient high-frequency oscillation and a following CR attenuation. As a result, a D.C. voltage $V_{dc}$ is applied between both electrodes on the average, as shown in FIG. 8B. The dust particles which proceed between both electrodes is charged by collision with unipolar ionic current generated from the aforementioned corona discharge, and then are driven by the mean D.C. field due to said $V_{dc}$ towards the dust collecting electrode to remove.

In such a case, the pulse corona generated on the whole discharge electrode becomes more uniform and more intense, as the peak value of pulse high-voltage is increased and the build up becomes more rapid. On the other hand, an excessive build up can cause damage to the high-voltage switch element. Thus, the above-mentioned initial high-frequency oscillation is of importance in the pulse chargeing system of this invention. To regulate the value and the period of said oscillation, an inductance having an appropriate value can be connected in series to the high-voltage switch element, if necessary. in such a case, an ideal current distribution can be obtained when the time of build up is less than several hundred nanoseconds. It is desirable to make the time of build up less than 2 microseconds for holding the uniformity in current distribution. When an element which can be turned off by applying a backward voltage, such as thyristor, is selected as high-voltage switch element, the necessary OFF action after ON action can be conducted automatically by virtue of backward voltage owing to said transcient oscillation. Moreover, the initial peak voltage between both electrodes can be made far higher than the charging voltage $V_0$ of pulse-forming capacitor.

In accordance with the present invention, there is provided a novel pulse-charging type electric dust collecting apparatus comprising generally a casing, an inlet for dust-laden gas, an outlet for clean gas, a dust discharge port, a grounded dust collecting electrode, a discharge electrode arranged to confront and be insulated from said dust collecting electrode, both electrodes being installed in gas passage within said casing, and a high-voltage power source for applying a high-voltage between said dust collecting electrode and said discharge electrode to generate a corona discharge from discharge electrode, which is characterized by comprising a high-voltage pulse power source, as said high-voltage power source, which comprises a pulse voltage-forming capacitor having one end grounded, a high-voltage charging power source connected to both ends of said capacitor to charge the same, and a high-voltage switch element for discharge having high-speed ON-OFF function which is inserted between the non-grounded terminal of said capacitor and said discharge electrode, said switch element being capable of connecting periodically between said terminal and said electrode for a short period of time for applying the charging voltage of said capacitor between said discharge electrode and said dust collecting electrode as pulse high-voltage and capable of being reset in OFF state immediately thereafter, the output terminals of said high-voltage pulse power source which are connected to the terminal on discharge electrode side of said high-voltage switch element for discharge and to the grounded terminal of said pulse voltage-forming capacitor, respectively, being connected to said discharge electrode and to said dust collecting electrode, respectively, without intervention of any interface; and a current blocking mechanism provided within said high-voltage charging power source, which blocks any output current from said high-voltage charging power source to block a charging current flow into said pulse voltage-forming capacitor at least switch-on period from an ON action of said high-voltage switch element for discharge to a reset in OFF state of the same, with a result of preventing any generation of dynamic current into said discharge electrode, the output current blocking function mentioned above of said current blocking mechanism being removed during switch-off period of said high-voltage switch element for discharge for enabling charging of said pulse voltage-forming capacitor; whereby a pulse high-voltage is applied between said discharge electrode and said dust collecting electrode by turning on and off said high-voltage switch element for discharge with actuating the current blocking function of said current blocking mechanism, then, said pulse-forming capacitor is charged by removing said current blocking function of said current blocking mechanism and thereafter all above-mentioned operations are repeated periodically for generating pulse corona discharge periodically from said discharge electrode, thereby dust particles which proceed between both electrodes along with gas flow from said inlet for dust-laden gas are charged by ions from corona discharge, are collected on dust collecting electrode, are released therefrom and drop downward into said dust discharge port to be discharged outside, the cleaned gas being exhausted from said outlet for clean gas.

As a result of such a feature, the novel pulse-charging type electric dust collecting apparatus accoding to this invention enables pulse charging without employing any high cost and high power loss coupling interface between a charging power source and a discharge electrode. Thus, the remarkable effect is obtained that the pulse charging can be achieved at very low cost and with high efficiency.

The current blocking mechanism which is the basis for realizing the above-mentioned feature of this invention can be any mechanism or element which can inhibit charging of the capacitor by the charging power source and the generation of a dynamic current into the discharge electrode at least during the switch-on state of the high-voltage switch element, and enbles sufficiently charging of said capacitor by said charging power source during the switch-off state of said switch element. Suitable mechanisms consisting of circuit elements, mechanical elements and combinations thereof are employable. As high-voltage switch element for discharge of this invention are employable solid switch elements, such as thyristor and power transistor, discharge tube switch elements, such as thyratron and hydrogen thyratron, mechanical switch elements, such as spark gap, spark gap with trigger electrode, laser trigger type spark gap and rotary spark gap, and any other suitable elements. As pulse-forming capacitor of the present invention are employable oil-impregnated paper capacitor, ceramic capcitor, cable and any other suitable elements. However, ceramic capacitors having low internal inductance are preferred. Any power source having constant or variable output voltage can be employed as charging power source of the present invention. As the method for generating variable voltage are employable a system that the input A.C. voltage is controlled by an induction regulator or a saturable reactor, a system that the input A.C. voltage or current is phase controlled by anti-parallel connected thyristors, and any like systems. The charging power source can be constituted by a system wherein a half- or full-wave rectifier is attached to the secondary side (high-voltage side) of a high-voltage transformer, a system wherein a capacitor is further attached to the above-mentioned system, a system wherein a suitable inductance is connected in series to said rectifier, thereby the charging voltage surpassing the crest value of voltage on secondary side of transformer because of resonance charging, or a system wherein the charging voltage is elevated by means of a voltage doubler or multiplier rectifying circuit. In addition, it is obvious that as A.C. power source to be connected to the primary side of transformer are employable a commercial frequency power source, a power source having a frequency other than commercial one constituted with inverter circuit, and a variable frequency power source.

BRIEF DESCRIPTION OF THE DRAWINGS

The above-mentioned and other features and objects of the present invention will become more apparent from the following detailed description of preferred embodiments thereof in connection with the accompanying drawings in which.

DETAILED DESCRIPTION OF PREFERRED EMBODIMENTS OF THE INVENTION

Figure 1:
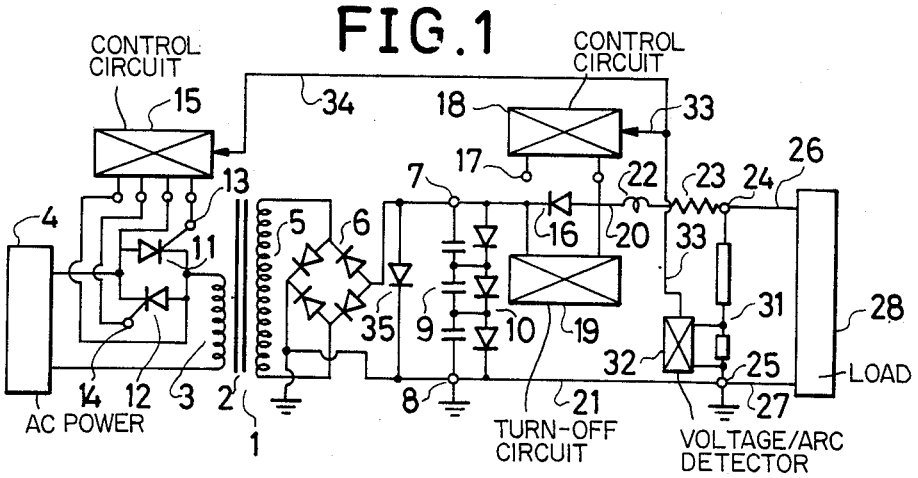
FIG. 1 is a circuit diagram showing one embodiment of the pulse high-voltage power source in accordance with this invention.

FIG. 1 represents a circuit diagram of an embodiment of the pulse high-voltage power source according to this invention. In this embodiment, a D.C. power source of full-wave rectifying circuit which has been broadly used for electric dust collecting apparatus in the prior art, as such, is employed as charging power source. A thyristor element provided with turn-off circuit is used as ON-OFF type high-speed high-voltage switch element mentioned above. The current blocking mechanism is composed by inserting additionally anti-parallel connected thyristor elements into the primary side of high-voltage transformer in said prior charging power source.

In FIG. 1, reference numeral 1 designates generally a charging power source which is composed of a high-voltage transformer 2, an A.C. low-voltage power source 4 connected to the primary winding 3 of transformer 2, and a full-wave rectifying circuit 6 connected to the secondary winding 5 of transformer 2. To output terminals 7 and 8 of circuit 6 is connected a pulse voltage-forming capacitor 9 consisting of many capacitor elements connected in series. Parallel to said capacitor 9 are inserted equalizer rectifying elements 10 which are biased in backward direction. By virtue of their non-linear backward direction characteristics, non-uniformity of shared voltage of each capacitor element is prevented to protect capacitor elements. As A.C. low-voltage power source 4 are employed a commercial frequency power source, a power source having a frequency different from commercial one which is provided by an inverter circuit, and also a power source having variable frequency. Reference numerals 11 and 12 denote anti-parallel connected thyristor elements which are connected between the primary winding 3 of said high-voltage transformer and the A.C. low-voltage power source. When gate signal currents are fed to respective gates 13 and 14 from a control circuit 15, the thyristors 11 and 12 can be turned on. Reference numeral 16 designates a thyristor as said ON-OFF type high-speed high-voltage switch element. By feeding the gate 17 thereof with a gate signal current, the thyristor can be turned on to take ON state. In the next step, the thyristor 16 can be turned off to take OFF state by feeding a backward current from a turn-off circuit 19 for making the current through thyristor 16 null. Reference numerals 20 and 21 designate lead wires. Reference numeral 22 denotes an inductance which regulates the rate of increase in forward direction current to protect the thyristor 16. Reference numeral 23 designates a resistance for attenuating any parasitic oscillation. Reference numerals 24 and 25 designate output terminals, one terminal 25 being grounded. Moreover, a load 28 is connected to both ends via lead wires 26 and 27.

The actuation of this embodiment of pulse high-voltage power source will be explained in connection with FIGS. 2A and 2B in the following.

Figure 2A:
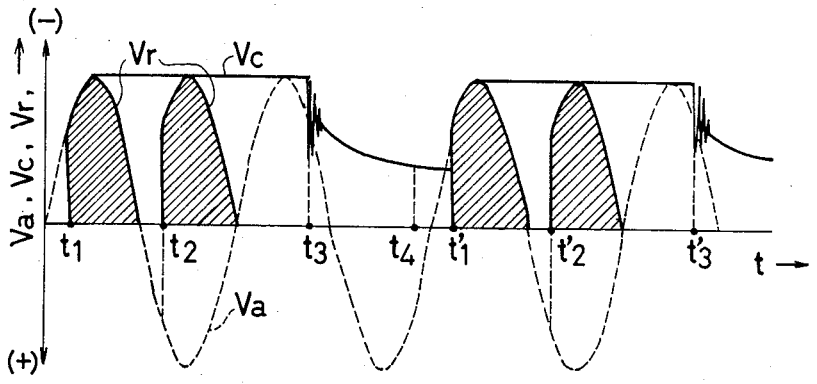
FIGS. 2A and 2B are diagrams showing actuations of pulse high-voltage power source of FIG. 1.
Figure 2B:
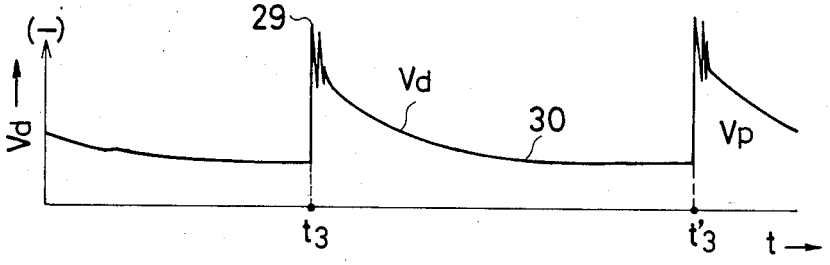

In FIG. 2A, a dotted line $v_a$ represents the waveform of output A.C. voltage at both ends of secondary winding 5 of high-voltage transformer 2 when a forward current always flows through the anti-parallel connected thyristors 11 and 12. Now, it is assumed that signal currents begin to flow from the control circuit 15 to the respective gates 13 and 14 of thyristors 11 and 12 at the points of time $t_1$ and $t_2$ of which the phases are shifted from respective zero points of voltage of positive and negative half periods of one cycle. Both thyristors are turned on at these points of time, respectively. Consequently, a negative-polar electromotive force corresponding to the shaded parts $v_r$ appears at terminals 7 and 8 of full-wave rectifying circuit 6 to charge negatively the pulse voltage-forming capacitor 9. As a result, the voltage at both ends of said capacitor 9 amounts to a constant value $v_c$ (in this embodiment, said value is equal to the crest value of voltage on secondary side). It should be noted that the upward sense in the ordinate of FIGS. 2A and 2B means a negative voltage. During next one cycle of A.C. voltage, the feeding of signal currents to gates 13 and 14 of thyristors 11 and 12 is stopped. In addition, a signal current is fed from the control circuit 18 to gate 17 of the thyristor 16 at a suitable point $t_3$ of time within this cycle. Then, the thyristor 16 is turned on momentarily. The charging voltage of capacititor 9 is impressed on both ends of load 28 via output terminals 24 and 25. When the load 28 is capacitive one having a capacity parallel to a resistance, a pulse high-voltage $v_d$ appears at both ends of load, as shown in FIG. 2B. This pulse high-voltage has a sharp peak 29 in building up period due to the transient L-C oscillation at the time of switching on. After attenuation of L-C oscillation, a sluggish CR attenuation 30 follows. However, as the anti-parallel connected thyristors 11 and 12 are kept in the OFF state during ON state of thyristor 16, the capacitor 9 is not charged by charging power source 1 and no dynamic current flows into the load.

Next, the turn-off circuit 19 is actuated at the point of time $t_4$ in the same cycle to feed a backward current to thyristor 16. When the current through it becomes null, the thyristor 16 is turned off and is reset in OFF state. In the next cycle of A.C. voltage, the anti-parallel connected thyristors are turned on again at the points $t_1'$ and $t_2'$ of time to charge the capacitor 9 and the subsequent operations are repeated. Thus, a periodic pulse voltage as shown by $v_d$ in FIG. 2B is periodically applied to both ends of load 28 without flowing in of dynamic current.

In this case, the charging voltage of capacitor 9 and hence the crest value $V_p$ of output pulse high-voltage can be lowered by shifting further the points $t_1$ and $t_2$ of time of feeding the signal current to gates 13 and 14 of the anti-parallel connected thyristors 11 and 12. The frequency $f_p$ of generated pulse high-voltage is a half of the frequency f of A.C. low-voltage power source in this embodiment. However, if the ON-OFF action of thyristor 16 and the charging are made to occur only one time for n cycles of A.C. low-voltage power source, the frequency $f_p$ can be 1/n of frequency f. In addition, the frequency $f_p$ can be easily varied when a variable frequency power source is employed as A.C. low-voltage power source 4. Reference numeral 31 designates a voltage divider connected to output terminals 24 and 25. When the load 28 is short-circuited by generation of spark etc. or by arcing ground, the voltage drop due to said short-circuit is immediately detected by the detector 32 and a signal thereof is input into the control circuits 18 and 15 via lead wires 33 and 34 to stop the feeding of signal currents to gates. The short-circuit current is stopped. In this case, a transient oscillation is generated by spark short-circuit. If a backward voltage (positive voltage in this embodiment) due to said oscillation is applied to capacitor 9, a dielectric breakdown is caused. To prevent these phenomena, a rectifier 35 is connected to both ends of capacitor 9 so as to have an allowable flow direction opposite to the polarity of normal charging voltage. Thus, the capacitor 9 is prevented from being charged backward. The rectifier 10 for dividing voltage can be employed to function in place of rectifier 35. In place of aforementioned voltage drop, an abrupt increase in output current from output terminals 24 and 25 may be detected by a current detector for finding arc or short-circuit. In addition, both current and voltage detections may be conducted simultaneously, and the result may be discriminated by a decision logical circuit suitably to input into control circuits 18 and 15. When the short-circuit or the arc disappears, such a disappearance may be discriminated so that the generation of pulse voltage recurs.

Figure 3:
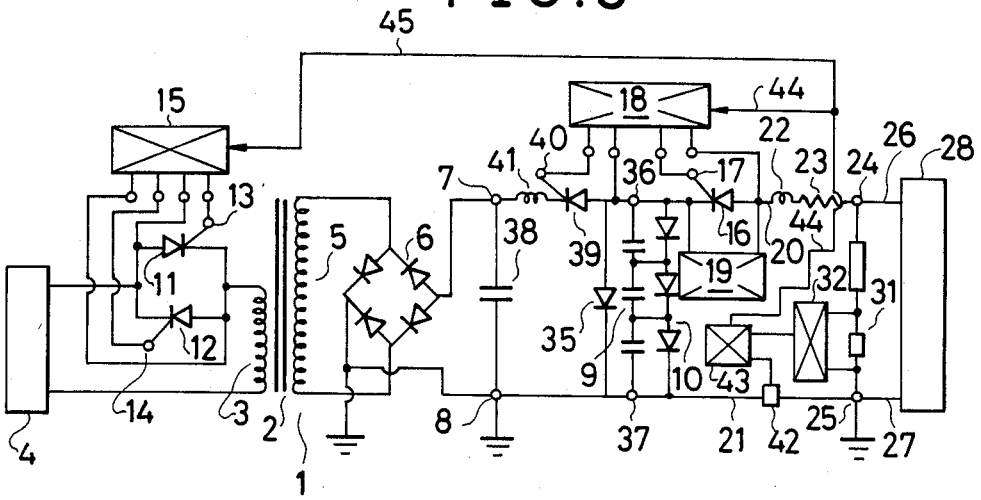
FIG. 3 is a circuit diagram of another embodiment.

FIG. 3 represents another embodiment of this invention wherein the full-wave rectifying type power source of the prior electric dust collecting apparatus is also employed. In FIG. 3, the appellation and the function of elements having reference numerals 1–35 are the same with those of elements having the same reference numerals in FIG. 1, respectively. Reference numerals 36 and 37 designate terminals of pulse voltage-forming capacitor 9. As can be seen in the drawing, a tank capacitor 38 having an electrostatic capacity $C_t$ far larger than that of pulse voltage-forming capacitor 9 is inserted between said capacitor 9 and the full-wave rectifier 6 parallel to capacitor 9. Moreover, a charging thyristor 39, as current blocking mechanism in this embodiment of the invention, is interposed between high-voltage terminals 7 and 36 of both capacitors. The gate 40 of thyristor 39 is constituted so as to be fed with separate control current from control circuit 18. Said control circuit 18 is for controlling thyristor 16 as pulse voltage generating high-speed high-voltage switch element.

Figure 4A:
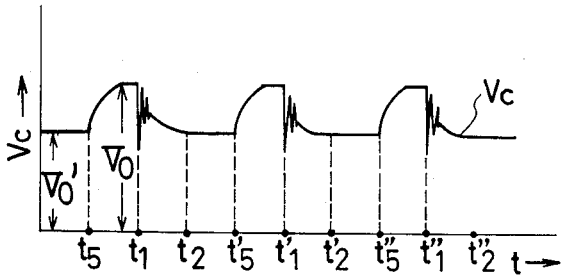
FIGS. 4A and 4B are diagrams showing actuations of the embodiment in FIG. 3, FIGS. 5, 6 and 7 represent circuit diagrams of other embodiments, respectively.
Figure 4B:
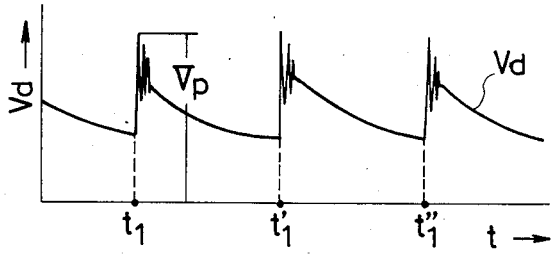

The actuation of this embodiment is depicted in FIG. 4A. The tank capacitor 38 has been charged by the charging power source 1 to a D.C. negative voltage $V_o'$. The value of $V_o'$ can be varied as desired by means of gate phase control of anti-parallel connected thyristors on primary side. First, when said charging thyristor 39 is turned on, the voltage of capacitor 38 is applied to the pulse-forming capacitor 9 via a resonance charging inductance 41 and the thyristor 39. The terminal voltage $v_c$ of the capacitor 9 is raised to a negative voltage value $V_o$ which is roughly double $V_o'$, due to a transient oscillation among the capacity $C_o$ of capacitor 9, inductance 41 and the capacity $C_t$ of tank capacitor 38. As the thyristor element 39 is impressed with a backward voltage immediately after the rise of $v_c$ and is turned off, the value of $v_c$ is kept at $V_o$. Then, the thyristor 16 as pulse voltage-forming high-speed high-voltage switch element is turned on at a point of time $t_1$. As a result, a pulse voltage as shown by a curve $v_d$ in FIG. 4B is impressed on the load 28. As the thyristor 39 as current blocking mechanism has been turned off at this time, the occurrence of dynamic current is completely inhibited. After a moment, the thyristor 16 is turned off by actuation of the turn-off circuit 19 at a point of time $t_2$ and the continuity between capacitor 9 and load 28 is interrupted. Then, charging of capacitor 9 again takes place at point of time $t'_5$. Thereafter, these operations are repeated. Because one period of the repetition $t_5$-$t_1$-$t_2$-$t'_5$-$t'_1$-$t'_2$- . . . can be selected as desired irrespective of the frequency of A.C. power source, the frequency $f_p$ of pulse output voltage can be freely controlled and the crest value of voltage $V_p$ also can be readily adjusted by gate-controlling of thyristors 11 and 12. Reference numeral 42 in the drawing designates a current detector inserted into lead wire 21, which detects an increase in current due to a spark short-circuiting or generation of arc in the load 28 and feed a signal thereof to the decision circuit 43. The decision circuit receives said signal together with an output signal from the voltage detector and discriminates a generation of short-circuit or arc. The output control signal from the decision circuit is fed to the control circuits 18 and 15 via lead wires 44 and 45 and stops the turn-on state of thyristor elements 16, 39, 11 and 12 to eliminate arcing. Thereafter, the normal operation continues.

Figure 5:
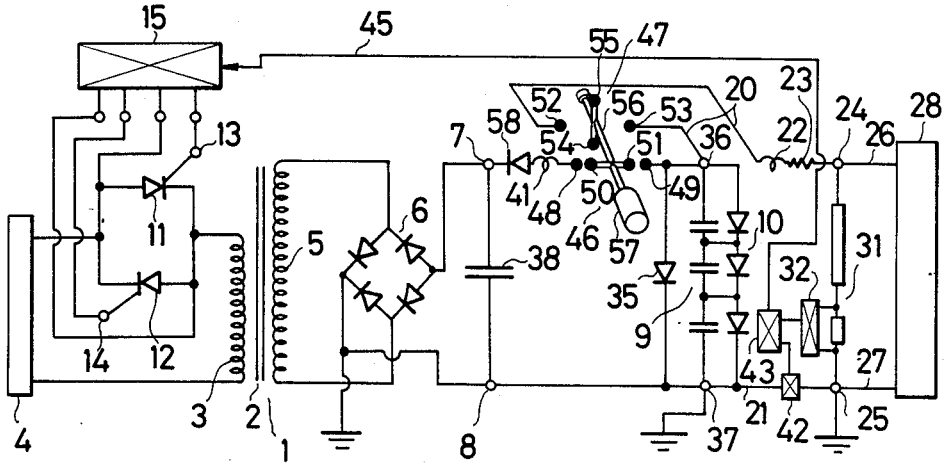

In FIG. 5 is shown a modification of the embodiment in FIG. 3 wherein two rotary spark switches 46 and 47 are employed in place of thyristors 16 and 39. Two rotary spark switches comprise two rotary electrodes at right angle with each other which have been mounted on the same rotating shaft. By means of these switches, the capacitor 9 can be charged, can be disconnected from capacitor 38, and can be connected to and disconnected from the load 28. Thus, this modification operates in the same manner as the embodiment of FIG. 3. In FIG. 5, the appellation and the function of elements having reference numerals 1–45 are the same with those of elements having the same reference numerals in FIGS. 1 and 3, respectively. In this embodiment, the rotary spark switch 46 acts as current blocking mechanism. Referencce numerals 48 and 49 designate fixed electrodes of rotary spark switch 46. Reference numerals 50 and 51 designate rotary electrode poles which are connected each other. In addition, the rotary spark switch 47 acts as pulse voltage-forming ON-OFF type high-speed high-voltage switch element. Reference numerals 52 and 53 designate the fixed electrodes of switch 47, and reference numerals 54 and 55 designate the rotary electrode poles of switch 47, which are connected each other. Reference numeral 56 designates a rotating shaft on which two rotary electrodes are mounted in a posture at right angle with each other. Reference numeral 57 designates a variable speed electric motor for rotating said shaft 56. In this case, the ON action of the switch is secured by spark generated in the period of the rotary electrode poles approaching the fixed electrode. The OFF action of the switch is secured by their opening. Because the rotary electrodes of both rotary spark switches 46 and 47 are at right angle with each other, one of rotary spark switches is assuredly in OFF state when the other of them is in ON state. The frequency $f_p$ of output pulse voltage can be varied by controlling the number of rotation of said variable speed electric motor 57. Reference numeral 58 designates a backward current-preventing rectifier which plays an important role in maintaining the value of voltage of capacitor 9 after resonance charging. As the actuation of this embodiment is obvious, the explanation therefor is omitted. The prior power source for electric dust collecting apparatus, as it is, can be employed in this system. In this embodiment, the rotary electrodes 46 and 47 can be mounted on respective separate rotating shafts rather than on one and the same rotating shaft, provided that said two rotary electrodes are set at right angle with each other. Two rotating shafts may be mechanically coupled by gear, chain, belt etc. so as to have the same number of rotation. It goes without saying that the right angle relation of both rotary electrodes may be maintained by driving two rotating shafts with phase-adjusted synchronous motors, in place of mechanically coupling. In addition, the number of rotary electrode poles can be any even number, such as 4, 6 and 8, with 2 poles of fixed electrode, in place of using 2 poles of each electrode. Otherwise, the number of fixed electrode poles can be any even number, such as 4, 6 and 8, with 2 poles of rotary electrode. With these means, the pulse frequency $f_p$ can be increased. It is obvious that both electrodes must make an electrical angle 90° instead of geometrical angle being 90°. Additionally, both rotary spark switches 46 and 47 may have a common rotary electrode with arranging pole pairs of two fixed electrodes having electrical angle 90° with each other around said common rotary electrode. On the other hand, when the load is large, the load may be divided. The divided parts of load can be separately charged by the method that a common tank capacitor 38 and a common rotary spark switch 46 are employed and some combinations of pulse-forming capacitor 9 and rotary spark switch 47 are connected to said two common elements. Further, in the case of the embodiment in FIG. 5, a thyristor can be used as charging switch element and a rotary spark switch can be employed as ON-OFF type high-speed high-voltage switch element. If such is the case, it is obvious that the voltage of pulse-forming capacitor 9 can be easily raised to double the voltage of the tank capacitor 38 without inserting the backward current-preventing rectifier 58 as well, taking advantage of resonance charging by L-C oscillation. In the event of short-circuit or arcing in load, the possible discharge of tank capacitor can be prevented by stopping immediately turned-on state of said charging thyristor. In the embodiment in FIG. 5, the inductance 41 and the rectifier 58 may be inserted in series between charging rotary spark switch 46 and pulse voltage-forming capacitor. Thereby, the advantage that the charged voltage of pulse-forming capacitor can be raised to roughly double the voltage of tank capacitor by virtue of resonance charging by L-C oscillation remains unaltered.

Figure 6:
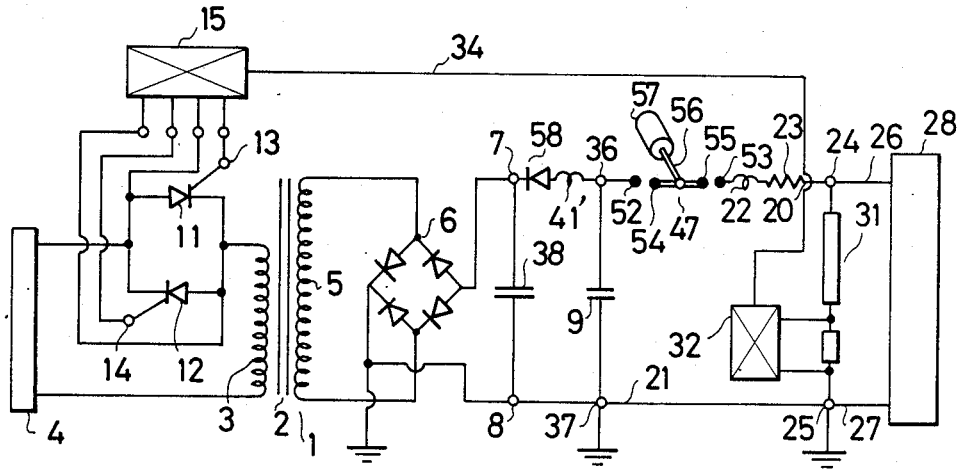

In FIG. 6 is shown a modification of embodiment in FIG. 5 wherein an inductance element 41' is used in place of rotary spark switch 46 as the current blocking mechanism in accordance with this invention. The power source of the prior electric dust collecting apparatus is employable also in this embodiment. In this embodiment, even when the rotary spark switch 47 is driven into ON state by variable speed electric motor 57 to close the path between capacitor 9 and load 28 and the charging voltage of capacitor 9 is applied to load 28, the rapidly recharging of capacitor 9 and the generation of dynamic current are surpressed, meanwhich the rotary electrode poles 54 and 55 of rotary spark switch 47 leave the fixed electrode poles 52 and 53 to break the continuity between capacitor 9 and load 28. Until said spark switch is next in On state, the capacitor 9 is completely resonance charged by tank capacitor 38 via inductance 41' and rectifier 58. These operations are repeated. In this embodiment, when both ends of load 8 are short-circuited by arcing, a signal produced by the voltage drop due to short-circuit is input into the control circuit 15 for anti-parallel connected thyristors 11 and 12 on the primary side of high-voltage transformer 2 via voltage divider 31, voltage detector 32, and lead wire 34. Immediately, the primary current is stopped to extinguish the arc. Then, after the extinction of arc, the continuity through thyristor 11 and 12 is restored by a command from a decision circuit not shown in the drawing. In this embodiment also, the value $V_p$ of output pulse voltage can be varied by gate phase control of thyristors 11 and 12, and the frequency of said pulse can be controlled by means of the number of rotation of electric motor 57.

Figure 7:
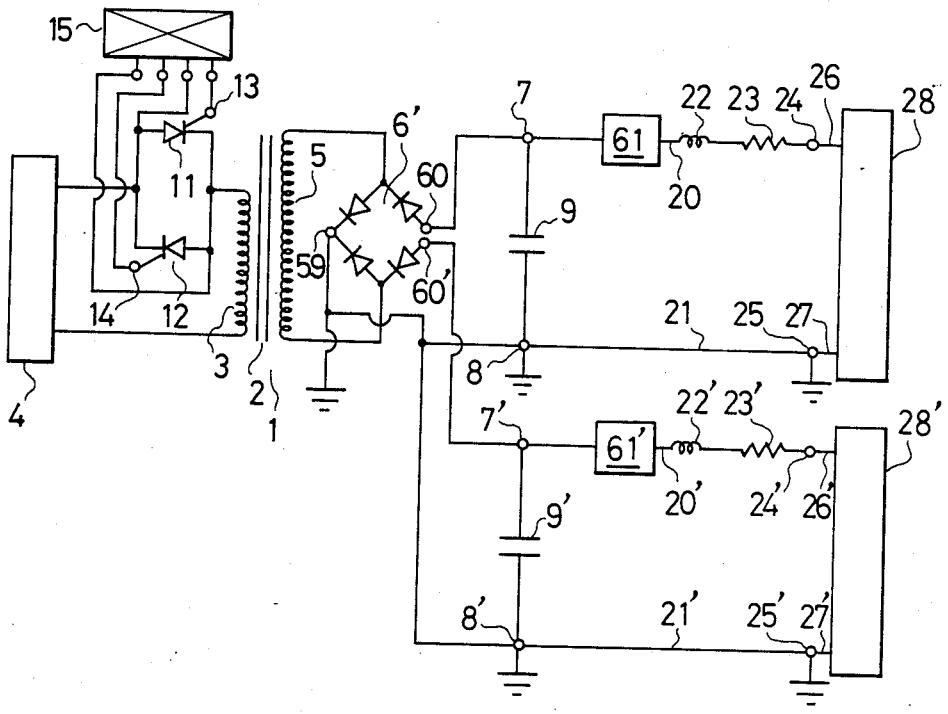
Figure 8A:
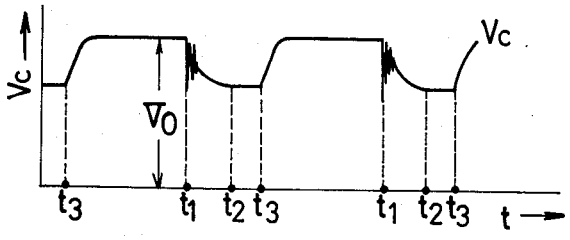
FIGS. 8A and 8B are diagrams which illustrate the principle of pulse charging in a pulse-charging type electric dust collecting apparatus according to this invention.
Figure 8B:
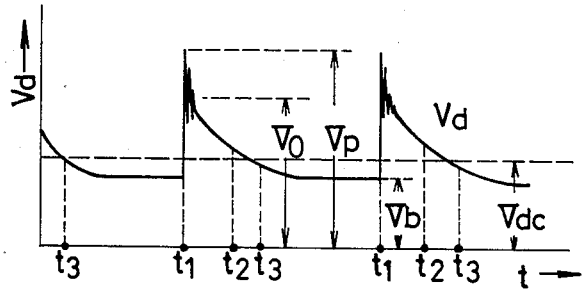

FIG. 7 shows an embodiment wherein a bridge type full-wave rectifying circuit is divided into two rectifiers and is employed as current blocking mechanism of this invention. In this embodiment, during each period of half cycle of A.C. forward high-voltage, each of the pulse voltage-forming capacitors connected respective rectifiers is charged with maintaining pertinent high-speed high-voltage switch element in OFF state. Then, during next half cycle where the polarity of A.C. high-voltage is inverted and the pertinent rectifier is in blocking state, the voltage of capacitor connected to said rectifier is applied to the pertinent part of load by turning on the pertinent high-speed high-voltage switch element. Thus, a pulse high-voltage is generated. As the rectifier is in blocking state at the time, flowing of current into said capacitor and said part of load is wholly prevented. As shown in the drawing, the bridge connection type full-wave rectifier 6' connected to the secondary side of high-voltage transformer 2 is grounded at an end 59 on the side which is not connected to secondary winding 5. The opposite end is divided into two ends 60 and 60' to open. The ends 60 and 60' are connected to terminals 7 and 7' on the high-voltage sides of two pulse voltage-forming capacitors 9 and 9', respectively. Further, the terminals 7 and 7' are connected to output terminals 24 and 24' via the high-speed high-voltage switch elements 61 and 61' comprising rotary spark switch 47 or thyristor element 16 both detailed above, respectively. They are further connected to ends on one side of parts 28 and 28' of load via lead wires 26 and 26'. On the other hand, the grounded terminals 8 and 8' of pulse-forming capacitors 9 and 9' are connected to ends on another side of parts 28, and 28' of load, via output terminals 25 and 25' and lead wires 27 and 27', respectively. By dividing the rectifier 6' and connecting the divided parts to respective following parts as mentioned above, terminals 7 and 7' on high-voltage side of pulse voltage-forming capacitors 9 and 9' are alternately negatively charged with respect to the grounded terminals 8 and 8' for every other half cycle of output charging voltage of high-voltage transformer 2, respectively. Said charging voltage can be modified as desired by gate phase control of anti-parallel thyristor elements 11 and 12 on the primary side. Then, during the next half cycle of A.C. voltage after negatively charging of capacitor 9, only the pulse voltage is applied to the load part 28 but the generation of a dynamic current is prevented by the current blocking action of two rectifying elements connected in series to capacitor 9 in rectifier 6', provided that the high-voltage switch element 61 is turned on and off. In the period of the same half cycle of A.C. voltage, the high-voltage switch element 61' is maintained in OFF state and the capacitor 9' is negatively charged. During the next half cycle of A.C. voltage, the capacitor 9 is charged but the high-voltage switch element 61 is maintained in OFF state. Simultaneously, the high-voltage switch element 61' is turned on and off under the current blocking state of two rectifying elements connected in series to the capacitor 9' and only the load part 28' is fed with pulse voltage. Thus, the load parts 28 and 28' are alternately impressed with pulse voltage for every other half cycle of A.C. voltage, the frequency of charging in each load part being equal to the frequency of A.C. voltage employed. In the primary winding 3 of high-voltage transformer 2 flows always A.C. current to prevent the magnetic deviation of iron core.

Figure 9:
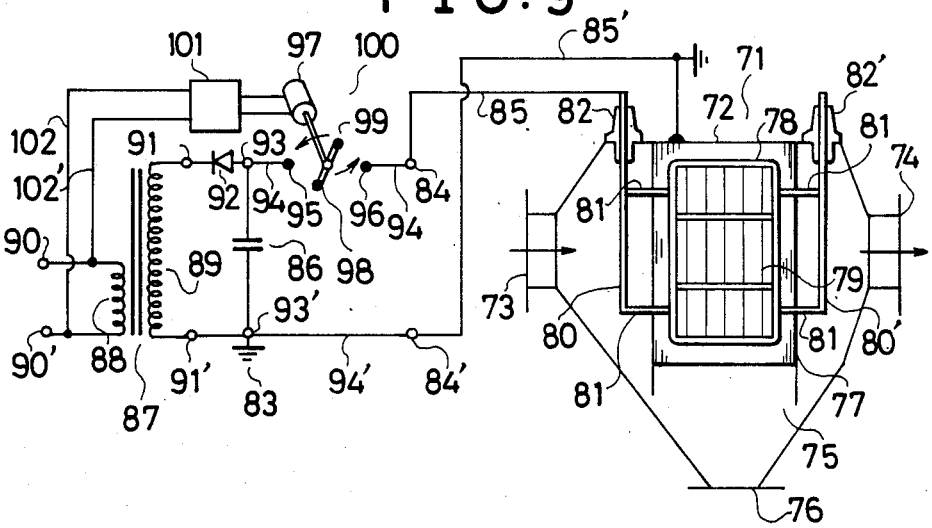
FIG. 9 represents a circuit diagram of one embodiment of pulse-charging type electric dust collecting apparatus according to this invention.

FIG. 9 illustrates one embodiment of the pulse-charging type electric dust collecting apparatus in accordance with this invention, wherein said current blocking mechanism is realized by means of a combination of a rectifier and a synchronous rotary spark switch which rotates synchronous with the frequency of A.C. charging current. Referring now to FIG. 9, there is shown an electric dust collecting apparatus 71 which comprises a casing 72, an inlet 73 for dust-laden gas, an outlet 74 for clean gas, a dust hopper 75, a dust discharge port 76, a group of many grounded dust collecting electrodes 77 which have been installed vertical, equidistant and parallel to the direction of gas current, and a group of discharge electrodes 79 which are mounted on metal frames 78 and installed between every two dust collecting electrodes insulated therefrom. Reference numerals 80 and 80' designate vertical metal supports for carrying said frame 78, which are supported by insulator tubes 82 and 82' and pass through the ceiling of casing 72. Reference numeral 83 designates a pulse high-voltage power source as one feature of the present invention. The output terminals 84 and 84' thereof are directly connected with the upper end of said support 80 and grounded dust collecting electrodes 77 via lead wires 85 and 85', respectively, so that the high-voltage of said pulse high-voltage power source is directly applied to said discharge electrode 79 and said dust collecting electrode 77. Reference numeral 86 designates a high-voltage pulse-forming capacitor. Reference numeral 87 designates a charging high-voltage transformer. Reference numerals 88 and 89 designate the primary winding (low voltage side) and the secondary winding (high-voltsge side), respectively. The input terminals 90 and 90' are connected to a suitable A.C. power source, e.g. a commercial frequency A.C. power source, a A.C. power source having a frequency different from commercial one which is provided by an inverter circuit, and an A.C. power source having variable frequency. One of terminals 91 and 91', i.e. terminal 91, is connected to a terminal 93 on the high-voltage side of said capacitor 86 via a rectifier 92. The terminal 91' is connected to a terminal 93' on the grounded side of said capacitor 86. Terminals 93 and 93' are further connected to the output terminals 84 and 84' via lead wires 94 and 94', respectively. However, a synchronous rotation spark switch 100 is inserted into said lead wire 94, which is composed of fixed electrode poles 95 and 96 and rotary electrode poles 98 and 99, said rotary electrode poles being connected each other and being driven by a synchronous electric motor to rotate. Said synchronous electric motor is connected with the A.C. power source on primary winding side by way of a phase adjusting device 101 and lead wires 102 and 102'. Said electric motor is constructed so as to rotate with a number of rotating per second being equal to a half of frequency of A.C. power source.

Figure 10A:
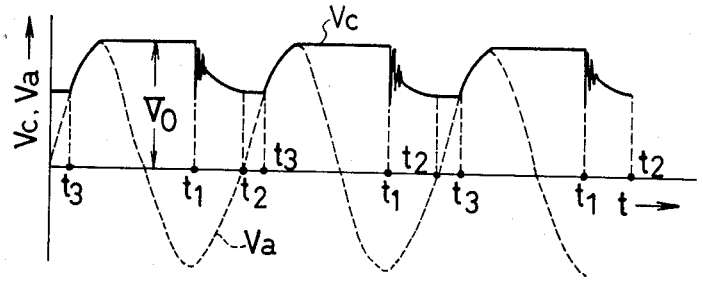
FIGS. 10A and 10B are diagrams showing actuations of the embodiment in FIG. 9.
Figure 10B:
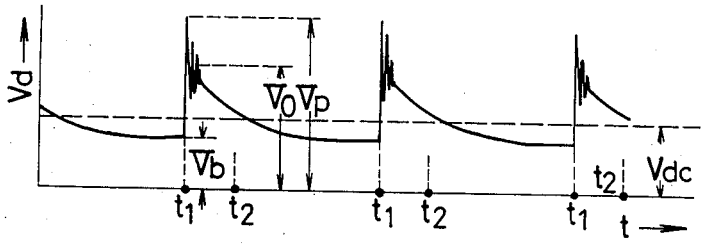

Now, the actuation of the pulse high-voltage power source will be detailed with referring to FIG. 10A. In the drawing, the absissa t represents time. The curve $v_c$ represents terminal voltages of capacitor 86 and the curve $v_d$ in FIG. 10B shows voltage of discharge electrode. The upward direction of ordinate corresponds to an increase in negative polarity. During the increasing period of negative polarity in output voltage $v_a$ on the secondary side of high-voltage reansformer 87, the capacitor 86 is charged via rectifier 92. The voltage $v_c$ thereof reaches the negative crest value $V_0$ of voltage $v_a$. Thereafter, the voltage $v_c$ is kept at $V_0$ due to current blocking action of rectifier 92. Then, at an appropriate point of time $t_1$ during a half cycle after the polarity is reversed to be positive, the terminal voltage of capactior 86 is momentarily applied between discharge electrode 79 and dust collecting electrode 77 via outputs terminals 84 and 84' and lead wires 85 and 85', provided that the phase adjusting device 101 has been so adjusted that the rotary electrode poles 98 and 99 of sychronous rotation spark switch 100 approach the fixed electrode poles 95 and 96 or 96 and 95 and generate sparks at point of time $t_1$. As a result, a voltage which is a combination of mean D.C. voltage $V_{dc}$ and superposed pulse voltage and has a crest value $V_p$, appears between both electrodes 79 and 77 due to the mechanism detailed above, as shown by $v_d$ in FIG. 10B. On the other hand, no dynamic current flows from charging power source by virtue of the blocking action of rectifier 92. As the rotary electrode poles 98 and 99 of synchronous rotation spark switch 100 leave the fixed electrodes 95 and 96 or 96 and 95 immediately after the generation of spark, the sparks between them are extinguished and said switch 100 is reset in OFF state at the point of time $t_2$. Thus, the feature of this embodiment consists in that the current blocking action of the rectifier 92, the synchronousness and the phase-selectivity of switching action of said synchronous rotation spark switch, and its mechanical function of switching off, are combined for switching off at desired time during a half cycle of reversed polarity of A.C. charging voltage in said capacitor and for preventing the generation of dynamic current. The current blocking mechanism of this invention has been embodied by a functional combination of said rectifier, said synchronous rotation spark switch, and said phase adjusting device. The value of $v_c$ is kept constant after the point of time $t_2$. When the polarity of A.C. charging voltage is reversed to be negative and surpasses said value $v_c$ at a point of time $t_3$, the capacitor 86 begins again to be charged and the voltage $v_c$ attains $V_0$, while the voltage $v_d$ of discharge electrode continues to attenute for this period of time. After the synchronous rotation spark switch has rotated one half turn, a pulse voltage is produced by generation of spark at the next point of time $t_1$. Thereafter, these operations are repeated.

By these operations, the discharge electrodes 79 performs pulse corona doscharge, and dust introduced from gas inlet 73 is charged and collected by dust collecting electrodes 77 on the basis of mechanaism mentioned above. The clean gas is exhausted through gas outlet 74 to a stack. The accumulated dust on the dust collecting electrodes 77 is released from the electrodes by hammering mechanically electrodes and drops downward into a hopper 75. The dust collected in hopper is discharged outward through dust discharge port 76. Generally, it is economical to make the electrostic capacity $C_0$ of capacitor 86 equal to the inter-electrode capacity $C_d$. When a low inductance or a low resistance is inserted into the path from capacitor to both electrodes, the surge at the beginning of sparkover between both electrode poles is prevented to invade the pulse power source and the period of initial transient oscillation in pulse voltage can be modified. In general, when the period is reduced to be less than 2 microseconds, a uniform pulse corona is generated on the whole surface of electrode and the ionic current density of dust collecting electrode becomes uniform. When the charging voltage of capacitor $V_0$ is taken to be high, the momentary peak voltage $V_p$ applied to discharge electrode 79 rises and hence the plasma density of pulse corona increases. As a result, there is a marked tendency for increasing of corona current, increasing of attenuation rate of $v_d$ and lowering of D.C. mean voltage $V_{dc}$ of discharge electrode. Therefore, when the electric resistance of dust is markedly high and the backward corona is generated vigorously, it is preferred that the corona current is supressed by lowering the charging voltage of capacitor $V_0$ and the value $V_{dc}$ is increased. When the electric resistance of dust is not so high and the generation of backward corona is low, it is preferred that the corona current is incresed by taking a relatively high value of $V_0$ and the charging rate of dust is enhanced. The regulation of the value $V_0$ is performed by varying the voltage of A.C. power source on the primary side of high-voltage transformer 87. Such a change of voltage can be done by any suitable well-known means for controlling the primary current, e.g. induction regulator and thyristor. The above-mentioned regulation of A.C. voltage on the primary side can be automatically performed by detecting the extent of inverse ionization with a suitable sensor or means, such as sensor for positive ion, antenna, and volt-ampere characteristic. In certain circumstances, the frequency of pulse power source can be made other than commercial frequency or can be variable by composing the A.C. power source on primary side with inverter or the like. Thus, the regulation of ionic current can be achieved also by controlling automatically or manually said frequency of power source on primary side. In addition, the rotary electrode of rotary spark switch 100 is not necessary to have two poles. The rotary electrode may have four, six, eight . . . poles (in general, even numbers of pole), as the case may be. Correspondingly, the number of rotation of synchronous electric motor 97 may be lowered to be $\frac{1}{2}$, $\frac{1}{3}$, $\frac{1}{4}$ . . . time original value. Even when the electrode is bipolar, the frequency of output pulse voltage can be converted to $\frac{1}{2}$, $\frac{1}{3}$, $\frac{1}{4}$ . . time original value by reducing the number of rotation of synchronous electric motor 97 to $\frac{1}{2}$, $\frac{1}{3}$, $\frac{1}{4}$ . . . time original value.

Figure 11:
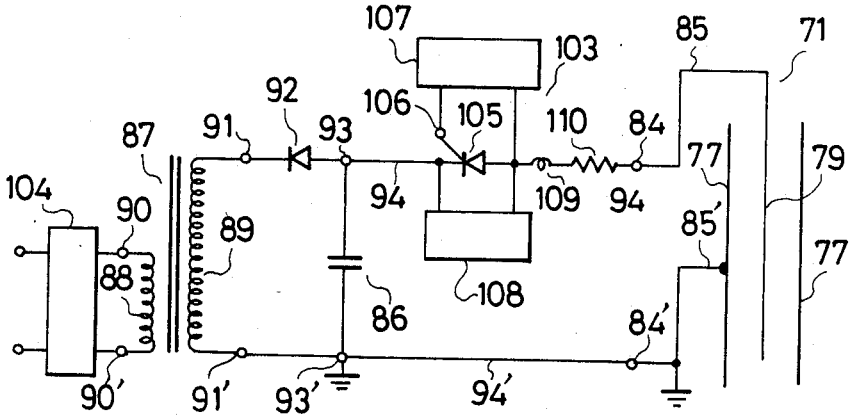
FIG. 11 is a circuit diagram of another embodiment.

FIG. 11 shows an embodiment of the present invention wherein 65 the synchronous rotation spark switch 100 of the embodiment in FIG. 9 is replaced by a thrystor 103. In this embodiment also, the system employed in said embodiment is utilized. The appellation and the function of the element having reference numerals 71–94 and 94' are identical with those of element having the same numerals in FIG. 9, respectively. Reference numeral 104 designates any voltage regulating apparatus for regulating the A.C. voltage on the primary side. The thyristor switch 103 of this embodiment consists of a thyristor element 105, a turn-on circuit 107 for feeding the gate 106 of said thyristor element with a controlling current, and a turn-off circuit 108 which feeds said thyrstor element 105 with a backward voltage to eliminate the current through it and interrupts the continuity thereof.

The actuation of pulse power source in this embodiment is identical with that in the embodiment of FIG. 9. The capacitor 86 is charged to the negative crest value $V_0$ of A.C. charging voltage by way of a rectifier 92, a control current is fed to the gate 106 from the turn-on circuit 107 to turn on the thyristor 105 at an appropiate point of time $t_1$ during a half cycle after the polarity of said A.C. voltage is reversed to be positive. As a result, the voltage of capacitor 86 is applied between the discharge electrode 79 and the dust collecting electrode 77 to form a pulse voltage. Thereafter, the turn-off circuit 108 is actuated at a point of time $t_2$ to turn off the thyristor element 105. The continuity between the capacitor 86 and the discharge electrode 79 is interrupted. The subsequent operations are performed as in the case of embodiment in FIG. 9. The waveforms of $v_c$, $v_a$ and $v_d$ are identical with those in FIGS. 10A and 10B. However, in this case, a minute inductance 109 and a resistance 110 are insterted in series into the circuit, in order to protect thyristor element 105 by limiting the build up of current. The rate of switching in this case is relatively low and is of the order of some microseconds, as compared with some nanoseconds in a spark switch. As mentioned above, a backward voltage is impressed on thyristor element 105 by initial transient L-C oscillation immediately after turning on. Therefore, when the duration is longer than turn-off time, the pertinent turn-off circuit can be omitted. In addition, the thyristor element 105 may be controlled so as to turn on every two or some cycles of A.C. charging voltage, thereby the frequency of pulse voltage is reduced to a half or a certain fraction of the frequency of A.C. voltage and the corona current is decreased.

Figure 12:
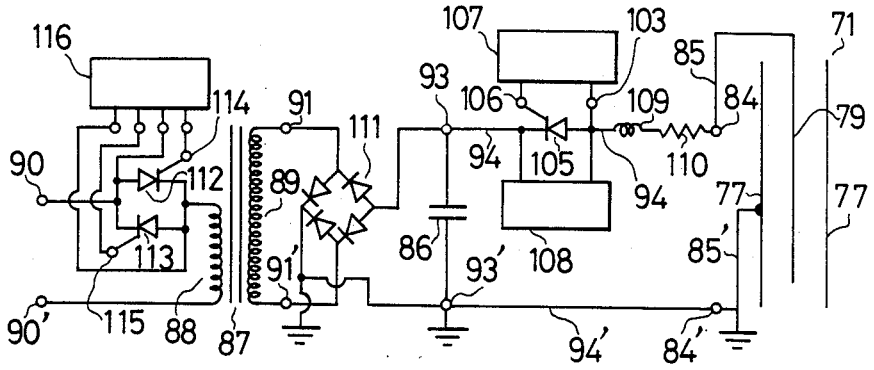
FIG. 12 is a circuit diagram of yet another embodiment.
Figure 13A:
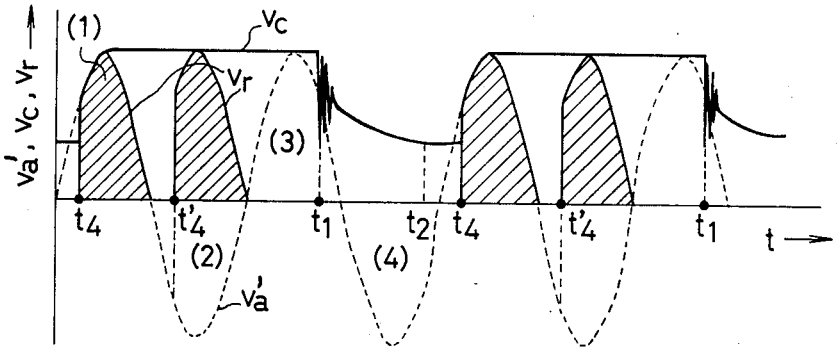
FIGS. 13A and 13B are diagrams showing actuations of the embodiment in FIG. 12.
Figure 13B:
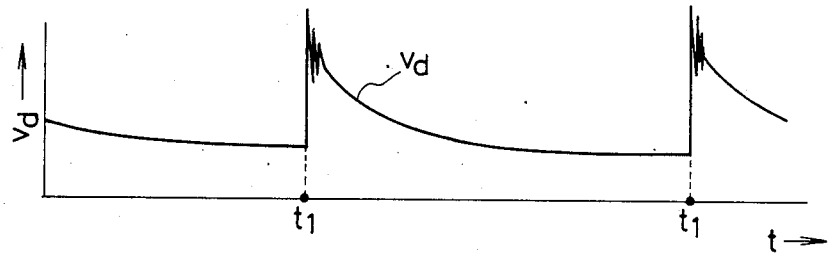

FIG. 12 shows one embodiment of this invention wherein a broadly used charging power source for full-wave rectifier of the prior art, as such, is employed as power source of electric dust collecting apparatus and anti-parallel connected thyristor elements are additionally inserted on the primary side of the high-voltage transformer as current blocking mechanism. In the drawing, the appellations and functions of elements having reference numerals 71–110 are identical with those of elements having the respective same reference numerals in FIG. 11. In this embodiment however, a bridge type full-wave rectifier 111 is used in place of the half-wave rectifier 92 in FIG. 11 and the capacitor 86 is charged through said full-wave rectifier. Reference numerals 112 and 113 designate anti-parallel connected thyristor elements on the primary side of a high-voltage transformer as current blocking mechanism. These thyristor elements are turned on when a control circuit feeds control currents to the respective gates 114 and 115 of said thyristor elements. When a backward voltage is applied to each of said thyristor elements to make current null, each thyristor element is turned off. Suppose that control currents are fed to the gates of thyristor elements 112 and 113 successively at a point of time $t_4$ in phase of forward half-wave of primary A.C. voltage, at similar point $t_4'$ and so on (refer to FIG. 13A). BY shifting these points of time $t_4$, $t_4'$ . . . in phase, the crest value of secondary voltage of transformer 87 and hence the charging voltage $V_O$ of pulse-forming capacitor 86 can be varied as desired. Further, unless said control currents are fed to gates 114 and 115, the primary current of high-voltage transformer is blocked. No voltage appears on the secondary side. Charging of capacitor 86 is not performed. Thus, no dynamic current flows into discharge electrode. The actuation of this embodiment is illustrated in FIGS. 13A and 13B. In the drawing, the dotted line $v_a'$ represents the imaginary output voltage to appear on the secondary side of high-voltage transformer 87, assuming that thyristor elements are always kept conductive. Now, during a positive half cycle (1) of alternating current, the thyristor element 112 is turned on at point of time $t_4$ which is latter in phase than a point of time of zero voltage. Then, during a negative half cycle (2) of alternating current, the thyristor element 113 is turned on at point of time $t_4'$ later in phase than a point of time of zero voltage. Meanwhile, negative voltage is impressed on capacitor 86 irrespective of the polarity of A.C. secondary voltage by virtue of action of full-wave rectifier 111. The impressed electromotive force is represented by a curve $v_r$. Thus, the capacitor 86 is charged by this electromotive force and its terminal voltage takes a form of curve $v_c$. Due to blocking action of full-wave rectifier 111, a crest value of voltage $V_0$ is maintained for a while. Then, feeding of control current to gates 114 and 115 is stopped during the next positive and negative half cycles and thyristors 112 and 113 is not turned on. For this quiescent cycle, charging of capacitor 86 is interrupted.. At a suitable point of time $t_1$ during this quiescent cycle, the thyristor switch element 105 is tured on to apply a pulse voltage to the discharge electrode 79. Thereafter, the thyristor element 105 is turned off at a point of time $t_2$ to interrupt the continuity. In the meantime, a voltage shown by a curve $v_d$ in FIG. 13B is applied to the discharge electrode. The capacitor 86 begins again to be charged at point of time $t_4$. These operations are repeated. Thus, a pulse voltage having a frequency equal to one half of frequency of A.C. power source is impressed on the discharge electrode for pulse charging.

Figure 14:
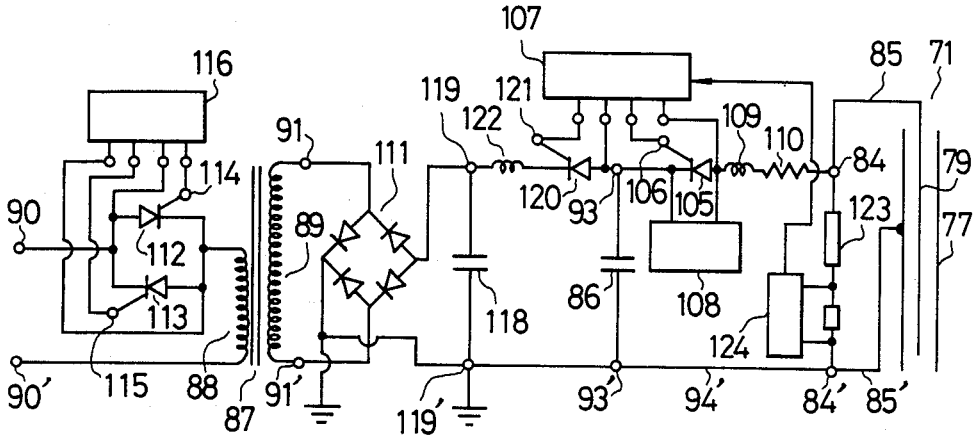
FIG. 14 is a circuit diagram of further other embodiment.

FIG. 14 represents another embodiment of this invention wherein an installed full-wave rectifying type power source for electric dust collecting apparatus is employed as charging power source. In the drawing, the appellations and functions of elements having reference numerals 71 to 116 are identical with those of elements having the respective same reference numerals in FIGS. 11 and 12. In FIG. 14, a tank capacitor 118 having a large electrostatic capacity $C_t$ is inserted between a full-wave rectifier 111 and a pulse voltage-forming capacitor 86, parallel to the latter, said electrostatic capacity $C_t$ being sufficiently larger than that of capacitor 86. Moreover, there is a thyristor element 120, as current blocking mechanism of this invention, between high-voltage terminals 93 and 119 of respective capacitors. It is so constructed that a separate control current is fed to the gate 121 of thyristor element 120 from a control circuit 107 for controlling thyristor element 105 as discharging high-voltage switch element.

Figure 15A:
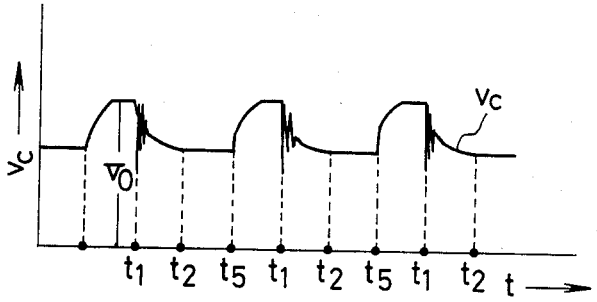
FIGS. 15A and 15B are diagrams showing actuation of the embodiment in FIG. 14, and FIGS. 16, 17 and 18 are circuit diagrams of other embodiments, respectively.
Figure 15B:
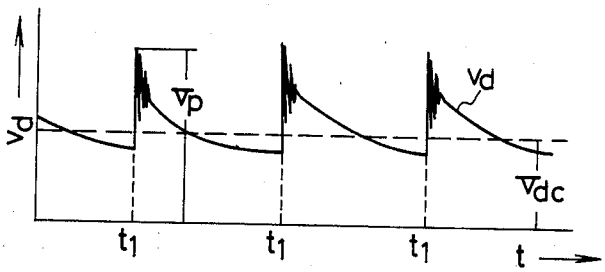

Now, the actuation of this embodiment will be detailed with referring to FIGS. 15A and 15B. Suppose that the tank capacitor 118 has been charged to a negative D.C. voltage $V_0'$ by charging power source. The value $V_0'$ can be varied as desired by gate controlling of anti-parallel connected thyristors 112 and 113 on the primary side. To begin with, when the thyristor element 120 is turned on at a point of time $t_5$, the voltage of capacitor 118 is applied to the pulse-forming capacitor 86 via an inductance 122 for resonance and the thyristor element 120, and the terminal voltage $v_c$ of capacitor 86 is raised to a negative value $V_0$ equal to roughly double $V_0'$ by transient oscillation between the capacity $C_0$ of capacitor 86, the inductance 122 and the capacity $C_t$ of tank capacitor 118. Immediately thereafter, a backward voltage is impressed on thyristor 120. Thus, the thyristor 120 is turned off and the voltage $v_c$ is maintained at $V_0$. Next, when the thyristor element 105 as high-voltage switch element for discharge is turned on at point of time $t_1$, a pulse voltage as shown by a curve $v_d$ in FIGS. 15A and 15B is impressed on the discharge electrode to pulse charge. As the thyristor 120 as current blocking mechanism has been turned off at the time, the generation of dynamic current is completely inhibited. The high-voltage thyristor element 105 for discharge is turned off at point of time $t_2$ immediately thereafter by actuation of the turn-off circuit 108, and the continuity between capacitor 86 and discharge electrode 77 is interrupted.

Charging of capacitor 86 begins again at next point of time $t_5$. Thereafter, these operations are repeated. In this embodiment, as the period of time of $t_5$-$t_1$-$t_2$-$t_5$ can be chosen as desired irrespective of frenquency of A.C. power source, the frequency of output pulse voltage can be freely controlled. Moreover, the crest value of said output pulse voltage can be adjusted as desired by phase control of gate signals of thyristors 112 and 113. Reference numeral 123 in FIG. 14 desigates a voltage divider which has been inserted between the output terminals 84 and 84' of pulse power source. The voltage drop due to conversion of spark into arc between discharge electrode 79 and dust collecting electrode is detected by a sensor 124 connected with said divider 123, and a resulting signal is input into a control circuit 107 for thyristor element to stop the turn-on state of thyristor element 105. Thereby, arc is extinguished. Thereafter, the normal operations again continue.

Figure 16:
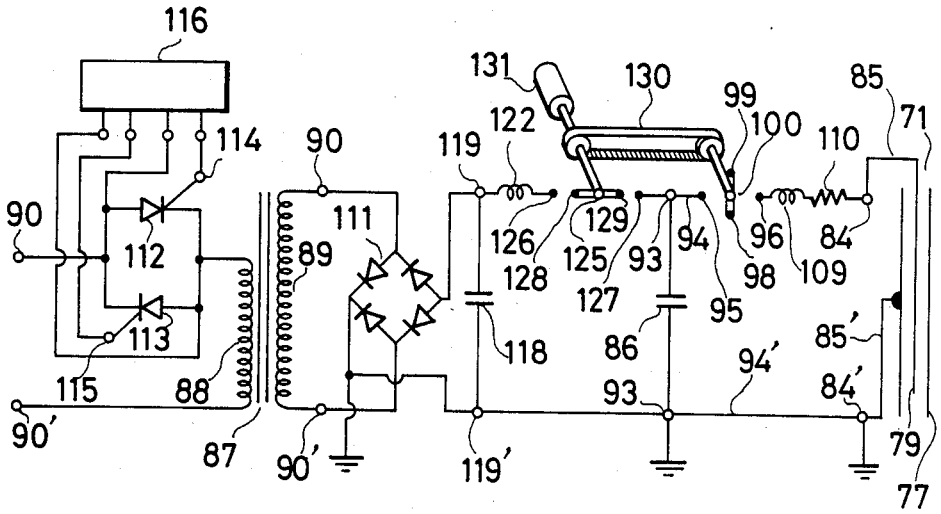

FIG. 16 shows a modification of the embodiment in FIG. 14, wherein two rotary spark switches 100 and 125 coupled each other are omployed in place of thyristor elements 105 and 120 in FIG. 14. The rotary electrode of switch 100 is at right angle to the rotary electrode of switch 125. By means of these switches, the capacitor 86 can be charged, disconnected from the capacitor 118, and connected to the discharge electrode 79. Thus, this modification operates in the same manner as the embodiment of FIG. 14. In FIG. 16, the appellations and functions of elements having reference numerals 71 to 122 are identical with those of elements having the respective same reference numerals in FIGS. 9 and 14. In this embodiment, the rotary spark switch 125 acts as current blocking mechanism. Reference numerals 126 and 127 designate the fixed electrodes of rotary spark switch 125. Reference numerals 128 and 129 designate the rotary electrode poles. Reference numeral 130 designate a coupling device for synchronously rotating two rotary electrodes of both rotary spark switches with keeping said two rotary electrodes at right angle with each other. In this case, the adjustment of frequency of output pulse voltage can be performed by controlling the number of rotation of variable speed electric motor 131 for driving said rotary electrodes. As the actuation of this embodiment is obvious, the explanation therefor is omitted. An installed power source for electric dust collecting apparatus, as such, can be employed also in this embodiment. It is obvious that, in this embodiment, rotary spark switches 100 and 125 may have a common rotating shaft on which two rotary electrodes are mounted so as to have a electrical angle of 90° with each other. In the case of the load of electric dust collecting apparatus is large, the load may be divided. The divided parts of load may be separately charged by a system comprising a commion tank capacitor 118, a common rotary spark switch 125, and some combinations of a pulse-forming capacitor 86 and a rotary spark switch connected thereto.

Figure 17:
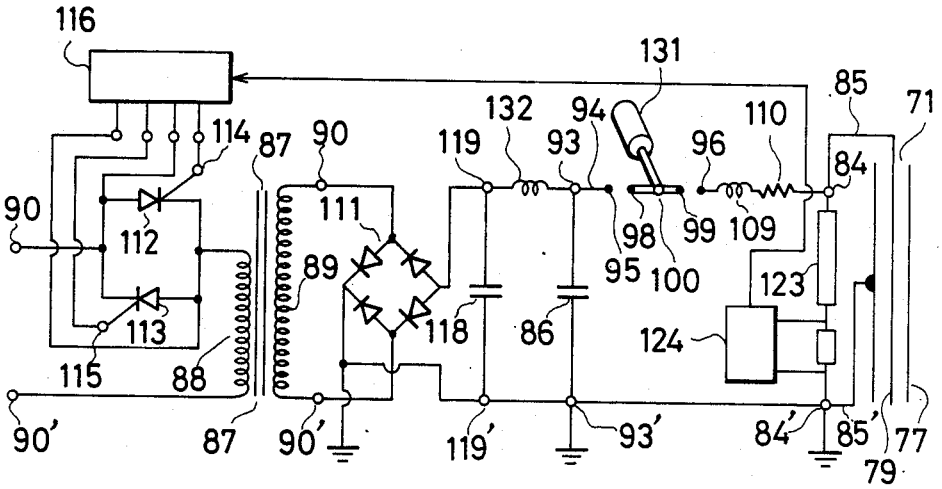

FIG. 17 represents a modification of the embodiment in FIG. 16, wherein an inductance element 132 is employed in place of rotary spark switch 125 as current blocking mechanism of this invention. An installed power source for electric dust collecting apparatus can be employed also in this modification. In this instance, the rotary spark switch 100 is driven by the variable speed electric motor 131 to be in ON state and the charging voltage of capacitor 86 is impressed on discharge electrode 79. Even when the capacitor 86 is connected to discharge electrode by sparks, charging of capacitor 86 and the generation of a dynamic current are prevented due to the action of inductance 132. Meanwhile, the rotary electrode poles 98 and 99 leave the fixed electrode poles 95 and 96, and the continuity between capacitor 86 and discharge electrode 79 is interrupted. During this interruption until the next turn-on of said rotary spark switch, the capacity 86 is completely charged by tank capacitor 118 via inductance 132. The subsequent operations mentioned above are repeated. In this case, if a short-circuit by arc is generated between discharge electrode and dust collecting electrode, a signal of voltage drop due to such short-circuit is input into a control circuit 116 of anti-parallel connected thyristor elements 112 and 113 on the primary side of high-voltage transformer 87, via voltage divider 123 and sensor 124. Immediately, the primary current is blocked and the generated arc is extinguished. After extinction of arc, the continuity through thyristors 112 and 113 is restored. In this embodiment also, the value of the output pulse voltage can be controlled by phase control of gate in thyristors 112 and 113, and the frequency of output pulse voltage can be controlled by means of number of rotation of electric motor 131.

Figure 18:
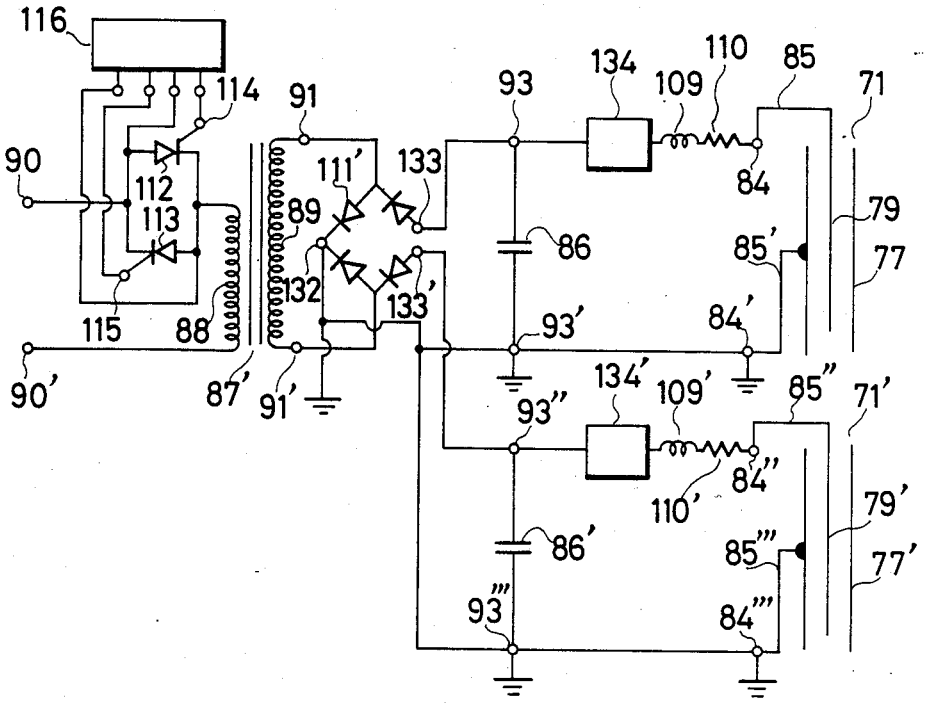

FIG.18 shows one embodiment of this invention, in which a bridge type full-wave rectifier is divided into two rectifiers and is employed in place of half-wave rectifier in the embodiment of FIG. 9 or FIG. 11, thereby any appearance of magnetic deviation of iron core due to D.C. component current flowing in the winding of high-voltage transformer 87 being prevented. In the drawing, the appellations and functions of the elements having reference numerals 71 to 116 are identical with those of elements having respective same reference numerals in FIGS. 9, 11 or 12. As shown in the drawing, the bridge connection type full-wave rectifier 111' connected to the secondary side of high-voltage transformer 87 is grounded at an end 132 on the side which is not connected to secondary winding 89. The opposite end is divided into two ends 133 and 133' to open. The ends 133 and 133' are connected to terminals 93 and 93'' on the high-voltage sides of two pulse voltage-forming capacitors 86 and 86', respectively. Further, the terminals 93 and 93'' are connected to output terminals 84 and 84'' via the discharging high-voltage switch elements 134 and 134' comprising synchronous rotation spark switch 100 or thyristor element 105 both detailed above, respectively. They are further connected to discharge electrodes 79 and 79' in two dust collecting chambers 71 and 71' of electric dust collecting apparatus, respectively. On the other hand, the grounded terminals 93 and 93''' of said pulse-forming capacitors 86 and 86' are connected to dust collecting electrodes 77 and 77' in said dust collecting chambers 71 and 71' via output terminals 84' and 84''', respectively. By dividing the rectifier 111' and connecting the divided parts to respective following parts as mentioned above, terminals 93 and 93'' on high-voltage side of pulse voltage-forming capacitors 86 and 86' are alternately negatively charged with respect to the grounded terminals 93' and 93''' for every other negative half cycle of output voltage of high-voltage transformer 87, respectively. The charging voltage can be freely modified by phase control of anti-parallel connected thyristor elements 112 and 113 on the primary side. With this constitution, during the half cycle of A.C. voltage after negatively charging of capacitor 86, the dust collecting chamber 71 is charged only with pulse charge but the generation of a dynamic current is prevented by the current blocking action of two rectifying elements connected in series to capacitor 86 in rectifier 111', provided that the high-voltage switch element 134 is turned on and off. In the period of the same half cycle of A.C. voltage, the high-voltage switch element 134' is maintained in OFF state and the capacitor 86' is negatively charged. During the next half cycle of A.C. voltage, the capacitor 86 is charged but the high-voltage switch element 134 is maintained in OFF state. Simultaneously, the high-voltage switch element 134' is turned on and off under the current blocking state in two rectifying elements connected in series to the capacitor 86' and only the dust collecting chamber 71' is pulse charged. Thus, the dust collecting chambers 71 and 71' are alternately pulse charged for every other half cycle of A.C. voltage, the frequency of charging in each dust collecting chamber being equal to the frequency of A.C. voltage employed. In the primary winding 88 of high-voltage transformer 87 flows always an A.C. current to prevent the magnetic deviation of iron core.

Although the invention has been described in connection with some preferred embodiments thereof, it will be appreciated by those skilled in the art that additions, modifications, substitutions and deletions not specifically described may be made without departing from the spirit and scope of the invention as defined in the appended claims.

What is claimed is:

1. A high-voltage pulse power source provided with a charging high-voltage power source which consists of a high-voltage transformer having a primary side and a secondary side, an A.C. power source connected to the primary low voltage side of said transformer, and a rectifying circuit connected to the secondary high voltage side of the same; a pulse voltage-forming capacitor connected to both output terminals of said transformer and having one end connected to a load; and a high-speed high-voltage switch element which is inserted between another end of said pulse voltage-forming capacitor and another end of said load, said switch element being capable of connecting periodically both ends of said capacitor to said load for a short period of time for applying the charging voltage of said pulse voltage-forming capacitor to both ends of said load as pulse high-voltage; which is characterized by comprising an ON-OFF type high-speed high-voltage switch element, substantially the same as said high-speed high-voltage switch element, which can be reset in an OFF state immediately after an ON action; and a current blocking mechanism connected to the output of said charging high-voltage power source, said current blocking mechanism inhibiting any output current from said charging power source to prevent charging of said pulse voltage-forming capacitor at least during the switch-on period from an ON action of said ON-OFF type high-speed high-voltage switch element to a reset in the OFF state of the same, with the result that any generation of dynamic current into said load is prevented; and a control circuit means for removing the output current inhibiting function of said blocking mechanism during the switch-off period of said ON-OFF type high-speed high-voltage switch element for enabling charging of the pulse voltage-forming capacitor; for applying a pulse high-voltage to both ends of said load by turning on and off said ON-OFF type high-speed high-voltage switch element with the current inhibiting function of said current blocking mechanism, for charging said pulse-forming capacitor by removing the current inhibiting function of said cuurent blocking mechanism and for thereafter repeating all above-mentioned operations periodically for applying a periodic pulse high voltage to said load.

2. A high-voltage pulse power source as claimed in claim 1, wherein said A.C. power source is an A.C. power source having variable frequency.

3. A high-voltage pulse power source as claimed in claim 1 which is characterized in that said current blocking mechanism comprises two anti-parallel connected thyristors inserted between the primary side of said high-voltage transformer and said A.C. power source, said ON-OFF type high-speed switch element is a thyristor, and said rectifying circuit is a full-wave rectifying circuit, said control circuit means providing gate signals fed to said two thyristors which are so controlled that said two anti-parallel connected thyristors are alternately turned on every forward half cycle of said A.C. power source to charge said pulse voltage-forming capacitor, while said ON-OFF type high-speed high-voltage switch element in an OFF state, thereafter said ON-OFF type high-speed high-voltage switch element is turned on during the period of maintaining said two anti-parallel connected thyristors in an OFF state.

4. A high-voltage pulse power source as claimed in claim 3, wherein said thyristor ON-OFF type high-speed high-voltage switch element is provided with a turn-off circuit for turning off said thyristor and substantially eliminating any forward current therethrough.

5. A high-voltage pulse power source as claimed in claim 1 wherein said charging power source is composed by providing a tank capacitor having a large capacity connected in parallel to output terminals of said rectifying circuit, one end of said tank capacitor being connected directly with one end of said pulse voltage-forming capacitor and another end of said tank capacitor being connected to another end of said pulse voltage-forming capacitor through said current blocking mechanism, said control circuit means generating a pulse high voltage generated by a sequence wherein said pulse voltage-forming capacitor is charged with the accumulated charge on said tank capacitor by turning on said charging switch element during the period of maintaining said ON-OFF type high-speed high-voltage switch element in an OFF state, and then said ON-OFF type high-speed high-voltage switch element is turned on during the OFF state of said charging switch element after an OFF action of the same.

6. A high-voltage pulse power source as claimed in claim 5, in which both of said high-speed high-voltage switch element and said charging switch element are rotary spark switches provided with a fixed electrode and a rotary electrode, the rotary electrodes of said rotary spark switches rotating synchronously with each other.

7. A high-voltage pulse power source as claimed in claim 5, in which a rectifier and an inductance for resonance oscillation are inserted in series between said charging switch element and said pulse voltage-forming capacitor.

8. A high-voltage pulse power source as claimed in claims 6 or 7, in which the rotary electrode of the rotary spark switch high-speed high-voltage switch element and the rotary electrode of said rotary spark switch charging switch element are mounted on a common rotating shaft at an electrical angle of 90 degrees with each other.

9. A high-voltage pulse power source as claimed in claim 5 or 7, in which said high-speed high-voltage switch element and said charging switch element comprise a common rotary electrode and two pairs of fixed electrodes arranged around said rotary electrode, said two pairs of fixed electrodes being at an electrical angle of 90° with each other.

10. A high-voltage pulse power source as claimed in claim 5 or 7, in which said high-speed high-voltage switch element as well as said charging switch element is a thyristor.

11. A high-voltage pulse power source as claimed in claim 5 or 7, in which said current blocking mechanism comprises an inductance element.

12. A high-voltage pulse power source as claimed in claim 5 or 7, wherein said ON-OFF type high-speed high-voltage switch element is a rotary spark switch and said charging switch element is a thyristor.

13. A high-voltage pulse power source as claimed in claim 1 or 2, wherein said rectifying circuit is a bridge connection type full-wave rectifying circuit, of which one end not connected to the secondary side of the high-voltage transformer is opened to form two separated parts of the bridge connection, and said pulse-forming capacitor comprises two separate pulse forming capacitors each having a non-grounded high-voltage terminal and a grounded terminal, said two separated parts of the bridge being connected to non-grounded terminals on the high-voltage side of the two separate pulse voltage-forming capacitors, respectively, the grounded terminals of said two separate pulse voltage-forming capacitors being connected together to the end opposite to said opened end of said bridge connection type full-wave rectifying circuit, and said non-grounded terminals on high-voltage side of two separate pulse voltage-forming capacitors being connected to two separate loads, through two separate ON-OFF type high-speed high-voltage switch elements which are turned on and off alternately with every half cycle of A.C. voltage while the pertinent separated part of said opened rectifying circuit is in a blocking state, respectively.

14. A high-voltage pulse power source as claimed in anyone of claims 1 through 7, wherein a backward bias rectifier is connected parallel to said pulse voltage-forming capacitor for preventing backward charging of the same.

15. A high-voltage pulse power source as claimed in anyone of claims 1 through 7, which is characterized by being provided with at least one of a voltage detecting section including a voltage divider connected in parallel to output terminals and a current detecting section connected in series to one of said output terminals, for detecting any short-circuit or arcing in the load, whereby at least one of a voltage drop or an increase in current both due to a short-circuit or arcing, is detected and thereupon said current blocking mechanism is actuated to interrupt the output current from the charging power source.

16. A pulse-charging type electric dust collecting apparatus comprising a casing body provided with an inlet for dust-laden gas, an outlet for clean gas, and a dust discharge port, a grounded dust collecting electrode, a discharge electrode arranged to confront and be insulated from said dust collecting electrode, both electrodes being installed in a gas passage within said casing, and a high-voltage power source for applying a high-voltage between said dust collecting electrode and said discharge electrode to generate a corona discharge from said discharge electrode, which is characterized by comprising a high-voltage pulse power source said high-voltage power source comprising a pulse voltage-forming capacitor having one terminal grounded and one terminal non-grounded, a high-voltage charging power source connected to both terminals of said capacitor to charge the same, and a high-voltage switch element for discharge having a high-speed ON-OFF function, said high-voltage switch element being inserted between the non-grounded terminal of said capacitor and said discharge electrode, said switch element periodically connecting said non-grounded terminal and said discharge electrode for a short period of time for applying the charging voltage of said capacitor between said discharge electrode and said dust collecting electrode as pulse high voltage and said switch element resetting to an OFF state immediately thereafter, the output terminals of said high-voltage pulse power source which are connected to the terminal on the discharge electrode side of said high-voltage switch element for discharge and to the grounded terminal of said pulse voltage-forming capacitor, respectively, being connected directly to said discharge electrode and to said dust collecting electrode, respectively, without intervention of any interface; and a current blocking mechanism provided within said high-voltage charging power source, which blocks any output current from said high-voltage charging power source to block a charging current flow into said pulse voltage-forming capacitor at least during the switch-on period from an ON action of said high-voltage switch element for discharge to a reset in the OFF state of the same, thus preventing any generation of dynamic current into said discharge electrode, the output current blocking function mentioned above of said current blocking mechanism being removed during the switch-off period of said high-voltage switch element for discharge for enabling charging of said pulse voltage-forming capacitor; whereby a pulse high voltage is applied between said discharge electrode and said dust collecting electrode by turning on and off said high-voltage switch element for discharge while actuating the current blocking function of said current blocking mechanism, then, said pulse-forming capacitor is charged by removing said current blocking function of said current blocking mechanism and thereafter all above-mentioned operations are repeated periodically for generating pulse corona discharge periodically from said discharge electrode, thereby dust particles which proceed between both electrodes along with gas flow from said inlet for dust-laden gas are charged by ions from the corona discharge, are collected on the dust collecting electrode by electric force, are released therefrom and drop downward into said dust discharge port to be discharged outside, the cleaned gas being exhausted from said outlet for clean gas.

17. A pulse-charging type electric dust collecting apparatus as claimed in claim 16, in which said high-voltage charging power source comprises high-voltage transformer which is connected on a primary low-voltage side to an A.C. power source and on a secondary high-voltage side to a rectifier, and said high-voltage switch element for discharge comprises a synchronous rotation spark switch consisting of a fixed electrode and a rotary electrode rotating synchronously with the frequency of said A.C. power source, whereby said current blocking mechanism is realized by setting the rotary phase of said of said rotary electrode to said fixed electrode so that the distance between said fixed electrodes and said rotary electrode is too large to generate a spark between them during a half cycle of A.C. when the polarity of the secondary voltage of said high-voltage transformer is forward for said rectifier, and is too short for generating a spark between both electrodes during a half cycle of opposite polarity of alternating current.

18. A pulse-charging type electric dust collecting apparatus as claimed in claim 16, in which said high-voltage charging power source comprises a high-voltage transformer which is connected on a primary low-voltage side to an A.C. power source and on a secondary high-voltage to a rectifier, and said high voltage switch element for discharge comprises a thyristor switch element, whereby said current blocking mechanism is realized by controlling the feeding phase of signals to be fed to the gate of said thyristor so that said thyristor switch element is kept in an OFF state without turning-on action during a half cycle of A.C. when the polarity of the secondary voltage of said high-voltage transformer is forward for said rectifier, and is turned on during a half cycle of opposite polarity of alternating current.

19. A pulse-charging type electric dust collecting apparatus as claimed in claim 16, in which said high-voltage charging power source comprises a high-voltage transformer which is connected on a primary low-voltage side to an A.C. power source through a first thyristor element and on a secondary high voltage side to a rectifier, and said high-voltage switch element for discharge comprises a second thyristor switch element, whereby said current blocking mechanism is realized by controlling each gate signal to be fed to each thyristor element so that said first thyristor element on the primary side is turned on to charge said pulse voltage-forming capacitor while keeping said second thyristor switch element in an OFF state, and then said second thyristor switch element is turned on while keeping said first thyristor element on the primary side in an OFF state.

20. A pulse-charging type electric dust collecting apparatus as claimed in claim 16, in which said high-voltage charging power source comprises a high-voltage transformer which is connected on a primary low-voltage side to an A.C. power source and on a secondary low-voltage to a tank capacitor through a rectifier connected to both terminals on the secondary side of said transformer, one end of said tank capacitor being directly connected to the grounded terminal of said pulse voltage-forming capacitor and another end of said tank capacitor being connected to the non-grounded terminal of said pulse voltage-forming capacitor through a charging switch element current blocking mechanism, whereby said current blocking mechanism is realized by providing said charging switch element so that said charging switch element is turned on to charge said pulse voltage-forming capacitor while keeping said high-voltage switch element for discharge in an OFF state, and then said high-voltage switch element for discharge is turned on while keeping said charging switch element in an OFF state after an OFF action of the same.

21. A pulse-charging type electric dust collecting apparatus as claimed in claim 20, in which both of said high-voltage switch element for discharge and said charging switch element are rotary spark switch elements provided with a fixed electrode and a rotary electrode, rotary electrodes of said rotary spark switch elements rotating synchronously with each other.

22. A pulse-charging type electric dust collecting apparatus as claimed in claim 21, in which two rotating shafts of said rotary electrodes of both rotary spark switches are mechanically coupled to each other.

23. A pulse-charging type electric dust collecting apparatus as claimed in claim 21, in which both rotary electrodes of said rotary spark switches are mounted on a common rotating shaft.

24. A pulse-charging type electric dust collecting apparatus as claimed in claim 20, in which both of said high-voltage switch element for discharge and said charging switch element are thyristor elements.

25. A pulse-charging type electric dust collecting apparatus as claimed in claim 16, in which said current blocking mechanism comprises an inductance element.

26. A pulse charging type electric dust collecting apparatus as claimed in claim 16, in which said rectifying circuit is a bridge connection type full-wave rectifying circuit, of which one end not connected to the secondary side of the high-voltage transformer is opened to form two separated parts of the bridge connection, and said pulse-forming capacitor comprises two separate pulse forming capacitors each having a non-grounded high-voltage terminal and a grounded terminal, said two separated parts of the bridge being connected to non-grounded terminals on the high-voltage side of the two separate pulse voltage-forming capacitors, respectively, the grounded terminals of said two separate pulse voltage-forming capacitors being connected together to the end opposite to said opened end of said bridge connection type full-wave rectifying circuit, and said non-grounded terminals on high-voltage side of two separate pulse voltage-forming capacitors being connected to two separate discharge electrodes in a dust collecting chamber of said electric dust collecting apparatus through two separate ON-OFF type high-speed high-voltage switch elements which are turned on and off alternately with every half cycle of A.C. voltage while the pertinent separated part of said opened rectifying circuit is in a blocking state, respectively.

27. A high-voltage pulse power source as claimed in claim 2, which is characterized in that said current blocking mechanism comprises two anti-parallel connected thyristors inserted between the primary side of said high-voltage transformer and said A.C. power source, said ON-OFF type high-speed high-voltage switch element is a thyristor, and said rectifying circuit is a full-wave rectifying circuit, whereby gate signals fed to said two thyristors are controlled that said two anti-parallel connected thyristors are alternately turned on every forward half cycle of A.C. power source to charge said pulse voltage-forming capacitor while keeping the thyristor as ON-OFF type high-speed high-voltage switch element in the OFF state, and thereafter said ON-OFF type high-speed high-voltage switch element is turned on during the period of maintaining said two anti-parallel connected thyristors in the OFF state.

28. A high-voltage pulse power source as claimed in claim 2, wherein said charging power source is comprised of a tank capacitor having a large capacity connected in parallel to the output terminals of said rectifying circuit, one end of said tank capacitor being connected directly with one end of said pulse voltage-forming capacitor and another end of said tank capacitor being connected to another end of said pulse voltage-forming capacitor through a charging switch element acting as said current blocking mechanism, whereby a pulse high voltage is generated by a sequence that involves said pulse voltage-forming capacitor being charged with the accumulated charge on said tank capacitor by turning on said charging switch element during the period of maintaining said ON-OFF type high-speed high-voltage switch element in an OFF state, and then said ON-OFF type high-speed high-voltage switch element being turned on during the OFF state of said charging switch element after an OFF action of the same.

29. A high-voltage pulse power source as claimed in claim 28 in which both of said high-speed high-voltage switch element and said charging switch element are rotary spark switches provided with a fixed electrode and a rotary electrode, the rotary electrodes of said rotary spark switches rotating synchronously with each other.

30. A high-voltage pulse power source as claimed in claim 28 in which a rectifier and an inductance for resonance oscillation are inserted in series between said charging switch element and said pulse voltage-forming capacitor.

31. A high-voltage pulse power source as claimed in any one of claims 29 or 30 in which the rotary electrode of the rotary spark switch high-speed high-voltage switch element and the rotary electrode of said rotary spark switch charging switch element are mounted on a common rotating shaft at an electrical angle of 90 degrees with each other.

32. A high-voltage pulse power source as claimed in claims 28 or 30 in which said high-speed high-voltage switch element and said charging switch element comprise a common rotary electrode and two pairs of fixed electrodes arranged around said rotary electrode, said two pairs of fixed electrodes being at an electrical angle of 90 degrees with each other.

33. A high-voltage pulse power source as claimed in claim 28 or 30 in which said high-speed high-voltage switch element as well as said charging switch element comprise a thyristor.

34. A high-voltage pulse power source as claimed in claim 28 or 30 in which said current blocking mechanism comprises an inductance element.

35. A high-voltage pulse power source as claimed in claim 28 or 30 wherein said ON-OFF type high-speed high-voltage switch element comprises a rotary spark switch and said charging switch element comprises a thyristor.

36. A high-voltage pulse power source as claimed in claim 13, wherein a backward bias rectifier is connected parallel to said pulse voltage-forming capacitor for preventing backward charging of the same.

37. A high-voltage pulse power source as claimed in claim 14, which is characterized by provision of at least one of a voltage detecting section including a voltage divider connected parallel to the output terminals of said transformer and a current detecting section connected in series to one of said output terminals, for detecting any short-circuit or arcing in the load and actuating said current blocking mechanism to interrupt the output current from the charging power source.

* * * * *

UNITED STATES PATENT AND TRADEMARK OFFICE

CERTIFICATE OF CORRECTION

PATENT NO. : 4,665,476

DATED : May 12, 1987

INVENTOR(S) : Senichi Masuda

It is certified that error appears in the above-identified patent and that said Letters Patent is hereby corrected as shown below:

Column 3, line 8:
"inhiting" should be --inhibiting--
Column 7, line 21:
"accoding" should be --according--
Column 7, line 34:
"enbles" should be --enables--
Column 12, line 5:
"Referencce" should be --Reference--
Column 12, line 8:
After "connected" insert --to--
Column 12, line 14:
After "connected" insert --to--
Column 15, line 12:
"voltsge" should be --voltage--
Column 15, line 28:
After "connected" insert --to--
Column 15, line 44:
"reansformer" should be --transformer--
Column 16, line 25:
"doscharge" should be --discharge--
Column 16, line 35:
"electrostic" should be --electrostatic--
Column 17, line 35:
"thyrstor" should be --thyristor--
Column 17, line 56:
"insterted" should be --inserted--
Column 18, line 63:
"tured" should be --turned--
Column 19, line 56:
"frenquency" should be --frequency--

UNITED STATES PATENT AND TRADEMARK OFFICE

CERTIFICATE OF CORRECTION

PATENT NO. : 4,665,476

DATED : May 12, 1987

INVENTOR(S) : Senichi Masuda

It is certified that error appears in the above-identified patent and that said Letters Patent is hereby corrected as shown below:

Column 20, line 5:
"omployed" should be --employed--
Column 20, line 38:
"commion" should be --common--
Column 25, line 55:
Delete "of said" (second occurrence)

Signed and Sealed this

Twelfth Day of July, 1988

*Attest:*

DONALD J. QUIGG

*Attesting Officer*

*Commissioner of Patents and Trademarks*